US010655384B2

(12) United States Patent
Foley et al.

(10) Patent No.: US 10,655,384 B2
(45) Date of Patent: May 19, 2020

(54) DUAL MODE ARCHITECTURAL STRUCTURE COVERING

(71) Applicant: Hunter Douglas, Inc., Pearl River, NY (US)

(72) Inventors: Patrick E. Foley, Evergreen, CO (US); Mark Schwantdt, Thornton, CO (US); Paul Mischo, Broomfield, CO (US)

(73) Assignee: HUNTER DOUGLAS, INC., Pearl River, NY (US)

( * ) Notice: Subject to any disclaimer, the term of this patent is extended or adjusted under 35 U.S.C. 154(b) by 245 days.

(21) Appl. No.: 15/729,778

(22) Filed: Oct. 11, 2017

(65) Prior Publication Data

US 2018/0106100 A1 Apr. 19, 2018

Related U.S. Application Data

(60) Provisional application No. 62/410,369, filed on Oct. 19, 2016.

(51) Int. Cl.
*E06B 9/322* (2006.01)
*E06B 9/60* (2006.01)
(Continued)

(52) U.S. Cl.
CPC ..... *E06B 9/322* (2013.01); *E06B 9/32* (2013.01); *E06B 9/60* (2013.01); *E06B 9/68* (2013.01);
(Continued)

(58) Field of Classification Search
CPC ... E06B 9/322; E06B 9/32; E06B 9/60; E06B 9/68; E06B 9/74; E06B 9/80;
(Continued)

(56) References Cited

U.S. PATENT DOCUMENTS 4,513,805 A * 4/1985 Mase ..... E06B 9/80 160/299
4,681,279 A * 7/1987 Nakamura ..... E06B 9/68 160/294

(Continued)

FOREIGN PATENT DOCUMENTS

EP 0095108 A2 11/1983
EP 1039092 A2 9/2000

OTHER PUBLICATIONS

Extended European Search Report for EP application No. 17196885.2 dated Mar. 12, 2018, 9 pages.

*Primary Examiner* — Johnnie A. Shablack

(57) ABSTRACT

Example dual mode architectural structure coverings are described herein. The dual mode operation permits the covering to be operated by a motor and also manually by a user. An example dual mode architectural structure covering includes a covering, a drive shaft, a drive motor having a motor drive shaft, and a dual mode operation system. The dual mode operation system includes a bearing housing rotationally coupled with respect to the motor drive shaft and a slip clutch rotationally coupled with respect to the drive shaft. The bearing housing and the slip clutch are operatively associated with a one-way bearing. Rotation of the one-way bearing in a first direction causes the bearing to lock, while rotation of the one-way bearing in a second direction, causes the bearing to free rotate. In this manner, manual operation of the covering will not damage the motor or other shade components.

19 Claims, 16 Drawing Sheets

(51) Int. Cl.
*E06B 9/68* (2006.01)
*E06B 9/32* (2006.01)
*E06B 9/74* (2006.01)

(52) U.S. Cl.
CPC ..... *E06B 9/74* (2013.01); *E06B 2009/6845* (2013.01)

(58) Field of Classification Search
CPC ..... E06B 2009/6845; E06B 2009/2627; E06B 2009/6818; E06B 2009/807
See application file for complete search history.

(56) References Cited

U.S. PATENT DOCUMENTS 5,542,464 A * 8/1996 Shiina ..... E06B 9/56 160/296
5,799,716 A * 9/1998 Yamaguchi ..... E06B 9/62 160/291
6,129,131 A * 10/2000 Colson ..... E06B 9/262 160/171
6,158,563 A * 12/2000 Welfonder ..... E06B 9/90 160/291
6,223,802 B1 * 5/2001 Colson ..... E06B 9/262 160/171
6,244,325 B1 * 6/2001 Miller ..... E06B 9/62 160/310
6,628,029 B2 * 9/2003 Astegno ..... E06B 9/72 160/310
6,729,447 B2 * 5/2004 Takahashi ..... E06B 9/80 188/291
7,311,133 B2 * 12/2007 Anderson ..... E06B 9/262 160/170
7,886,803 B2 * 2/2011 Anderson ..... E06B 9/262 160/170
8,051,960 B2 * 11/2011 Nakajima ..... E06B 9/80 160/299
8,230,896 B2 * 7/2012 Anderson ..... E06B 9/262 160/170
8,893,766 B2 * 11/2014 Bohlen ..... E06B 9/88 160/323.1
8,947,027 B2 * 2/2015 Mullet ..... H02P 3/08 318/255
9,334,688 B2 * 5/2016 Colson ..... E06B 9/78
9,593,530 B1 * 3/2017 Anthony ..... E06B 9/322
9,725,948 B2 * 8/2017 Mullet ..... H02P 3/08
9,765,568 B2 * 9/2017 Colson ..... E06B 9/40
9,771,755 B2 * 9/2017 Mullet ..... E06B 9/40
9,790,738 B2 * 10/2017 Jung ..... E06B 9/42
9,963,935 B2 * 5/2018 Faller ..... E06B 9/80
10,138,676 B2 * 11/2018 Bohlen ..... E06B 9/62
10,180,029 B2 * 1/2019 Adreon ..... E06B 9/322
10,273,751 B2 * 4/2019 Colson ..... E06B 9/78
10,435,945 B2 * 10/2019 Buccola, Jr. ..... E06B 9/322
2004/0163774 A1 * 8/2004 Nien ..... E06B 9/307 160/168.1 P
2005/0035238 A1 * 2/2005 Fun ..... E06B 9/72 242/381
2008/0121353 A1 * 5/2008 Detmer ..... E06B 9/72 160/266
2009/0120592 A1 * 5/2009 Lesperance ..... E06B 9/322 160/84.02
2010/0219306 A1 * 9/2010 Detmer ..... E06B 9/72 248/201
2010/0236891 A1 * 9/2010 Lagarde ..... F16D 67/00 192/223.4
2011/0000628 A1 * 1/2011 Anderson ..... E06B 9/262 160/313
2013/0199735 A1 8/2013 Colson et al.
2013/0220560 A1 * 8/2013 Mullet ..... E06B 9/74 160/291
2014/0224437 A1 * 8/2014 Colson ..... E06B 9/78 160/291
2014/0290870 A1 * 10/2014 Colson ..... E06B 9/40 160/10
2015/0047795 A1 * 2/2015 Bohlen ..... E06B 9/62 160/316
2015/0090409 A1 * 4/2015 Mullet ..... H02P 3/08 160/7
2016/0222722 A1 * 8/2016 Schulman ..... E06B 9/322
2017/0130528 A1 5/2017 Anthony et al.
2017/0204661 A1 7/2017 Dann et al.
2017/0211657 A1 * 7/2017 Chen ..... E06B 9/307
2017/0218696 A1 * 8/2017 Chen ..... E06B 9/34
2017/0218697 A1 * 8/2017 Chen ..... E06B 9/34
2017/0218703 A1 * 8/2017 Wei ..... E06B 9/34
2017/0260806 A1 9/2017 Adams et al.
2018/0171703 A1 * 6/2018 Buccola, Jr. ..... E06B 9/322
2018/0179812 A1 * 6/2018 Dubina ..... E06B 9/42
2018/0258696 A1 * 9/2018 Faller ..... E06B 9/90
2018/0313144 A1 * 11/2018 Anderson ..... E06B 9/322
2018/0320438 A1 * 11/2018 Anderson ..... E06B 9/262
2019/0085632 A1 * 3/2019 Smith ..... E06B 9/72
2019/0218859 A1 * 7/2019 Campagna ..... E06B 9/42
2019/0234143 A1 * 8/2019 Colson ..... E06B 9/68
2019/0284876 A1 * 9/2019 Colson ..... E06B 9/68

* cited by examiner

DUAL MODE ARCHITECTURAL STRUCTURE COVERING

CROSS-REFERENCE TO RELATED APPLICATIONS

This application claims priority to pending U.S. Provisional Patent Application Ser. No. 62/410,369, filed Oct. 19, 2016, titled "Dual Mode Architectural Structure Covering", the entirety of which application is incorporated by reference herein.

FIELD OF DISCLOSURE

This disclosure relates generally to architectural structure coverings and, more particularly, to a dual mode architectural structure covering.

BACKGROUND OF THE DISCLOSURE

Architectural structure coverings may selectively cover a window, a door way, a skylight, a hallway, a portion of a wall, etc. Generally speaking, architectural structure coverings are extendable and retractable (e.g., able to be lowered or raised, respectively). Some coverings include a drive motor (e.g., an electric motor) that may be controlled to raise or lower the covering. For example, the drive motor may be operated in a first direction to raise the covering and may be operated in a second, opposite, direction to lower the covering. Other coverings may be manually operated to raise or lower the covering. For example, a beaded chain and a pulley, a rope and pulley, a worm gear, etc. may be incorporated so that a user can manually (by hand, without electric motorization) raise or lower the covering as desired.

In connection with the operation of known architectural structure coverings, motorized controllers are often used to lower or raise the covering. Known motorized architectural structure coverings may also incorporate a wireless transceiver to enable remote or wireless control. Alternatively, known architectural structure coverings may be manually operated to lower or raise the covering without electrical motorization. Generally speaking, a user can grab the covering, for example, via a bottom rail and pull up or down on the bottom rail to raise or lower the covering, respectively. Alternatively, the architectural structure covering can be equipped with a cord or chain that the user can pull in one direction or the other to raise or lower the covering, respectively.

Combining manual and motorized operation in an architectural structure covering may cause multiple problems. For example, manually operating an architectural structure covering that is coupled to a motor may cause the motor to rotate, which creates additional or undesirable torque to the system. Moreover, in known motorized architectural structural coverings, the covering cannot be manually operated because if the bottom rail is pulled down, the downward force applied by the user may damage the motor and lift system (e.g., lift cords and spools). Meanwhile, if the bottom rail is raised, if the motor does not rotate, the lift system will not take up the slack in the lift cords causing the covering to fall, returning to its previous undesirable position. In addition, a motorized architectural structure covering often requires a sensor to track the position of the covering so that a controller associated with the motor knows when the covering has reached its upper and lower limits. However, when a user manually adjusts the position of the motorized architectural structure covering, the controller no longer knows the exact position of the covering because the user altered the position of the covering without using the motor. This is a problem because the sensor no longer "knows" what the true upper and lower limits of the covering are.

SUMMARY OF THE DISCLOSURE

The present disclosure overcomes the problems associated with prior art devices by providing a dual mode architectural structure covering that permits the covering to be operated by a motor and also manually by a user. An example dual mode architectural structure covering includes a covering, a drive shaft, a drive motor having a motor drive shaft, and a dual mode operation system. The dual mode operation system may include a bearing housing rotationally coupled with respect to the motor drive shaft and a slip clutch rotationally coupled with respect to the drive shaft. The bearing housing and the slip clutch are selectively, rotatably coupled with respect to each other by the one-way bearing. That is, the bearing housing and the slip clutch are preferably operatively associated with a one-way bearing so that rotation of the one-way bearing in a first direction causes the bearing to lock, while rotation of the one-way bearing in a second direction, causes the bearing to freely rotate. In this manner, manual operation (without operating the drive motor, e.g., by hand) of the dual mode architectural structure covering will not damage the motor or other shade components (e.g., cord, fabric, mounting brackets, etc.). In use, the dual mode architectural structure covering will permit manual operation without damage to the motor regardless if the motor is running or not.

In use, the one-way bearing preferably includes an outer raceway and an inner raceway. The outer raceway is rotationally coupled to the bearing housing, and hence, to the motor drive shaft and the drive motor. The inner raceway is rotationally coupled to the slip clutch, and hence, the drive shaft. The outer raceway may be adapted and configured to selectively rotate with respect to the inner raceway so that, when the outer raceway rotates in the clockwise direction CW (e.g., the equivalent of the inner raceway rotating in the counter-clockwise direction CCW), the outer and inner raceway lock together and thus, rotate in unison (e.g., rotation from the outer raceway is transmitted to the inner raceway). Alternatively, when the outer raceway rotates in the counter-clockwise direction CCW (e.g., the equivalent of the inner raceway rotating in the clockwise direction CW), the outer and inner raceways rotate freely with respect to each other to decouple from each other so that rotation of the outer raceway is not transmitted to the inner raceway and vice-versa.

In this manner, the dual mode operation system may selectively couple the drive motor to the drive shaft to drive (e.g., rotate) the drive shaft to raise the covering when the drive motor is operated in a first direction, and to act as a speed governor in the second direction without directly driving the drive shaft so that gravity can lower the covering when the drive motor is operated in the second direction.

Meanwhile, the dual mode operation system is also adapted and configured to allow a person to manually (without operating the drive motor, e.g., by hand) operate the architectural structure covering by pulling the covering to lower the covering, and/or lifting the covering to raise the covering without imparting any rotation onto the drive motor. During manual operation, a spring motor may assist the user to raise the covering.

The dual mode operation system may also include a sensor system to identify the location of the covering at all times, whether the position of the covering is adjusted manually or via the motor. For example, a portion of the sensor system may be located on, or rotationally coupled with respect to, the drive shaft so that a position sensor can rotate independent of the coupling between the inner and outer raceways of the one-way bearing.

BRIEF DESCRIPTION OF THE DRAWINGS

By way of example, embodiments of the disclosed device will now be described, with reference to the accompanying drawings, in which.

DETAILED DESCRIPTION

Figure 1:
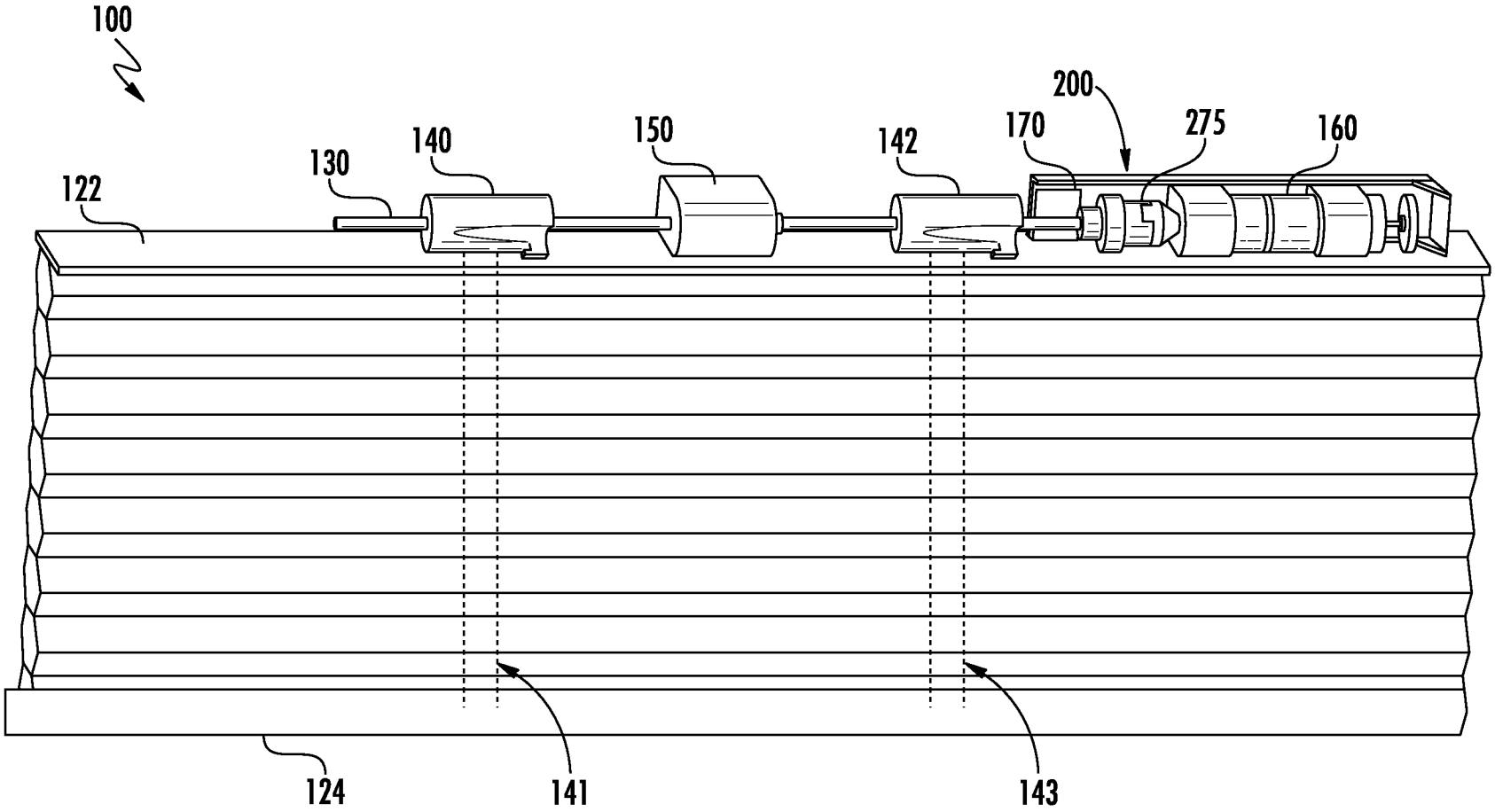
FIG. 1 illustrates a perspective view of an example embodiment of an architectural structure covering with a dual mode operation system in accordance with the present disclosure.

The following disclosure is intended to provide example embodiments of the disclosed system and method, and these example embodiments should not be interpreted as limiting. One of ordinary skill in the art will understand that the steps and methods disclosed may easily be reordered and manipulated into many configurations, provided they are not mutually exclusive. As used herein, "a" and "an" may refer to a single or plurality of items and should not be interpreted as exclusively singular unless explicitly stated.

The present disclosure is directed to an architectural structure covering that can operate in a dual mode. That is, the dual mode architectural structure covering according to the present disclosure can be operated by a motor and also manually by a user to lower or raise the covering. Thus, the dual mode architectural structure covering can be operated by a motor via a remote control, a building management system, one or more switches, etc. In addition, the dual mode architectural structure covering can be manually operated by a user without the use of an electric motor. For example, the user is able to manually operate the dual mode architectural structure covering should the remote control be lost, should there be a loss of power to the motor, if the user is standing nearby without the remote control, etc. Moreover, manual operation of the dual mode architectural structure covering will not damage the motor. Additionally, the dual mode architectural structure covering includes a sensor system able to track the position of the covering so that the upper and lower limits of the covering are retained, regardless of the mode of operation (i.e., manual or motorized).

The dual mode architectural structure covering according to the present disclosure includes a covering, a covering drive shaft, a drive motor having a motor drive shaft, a dual mode operation system, and, optionally, a sensor system for identifying the location of the covering. The dual mode operation system includes a bearing housing mechanically-rotatably coupled with respect to the motor drive shaft and a slip clutch mechanically-rotatably coupled with respect to the covering drive shaft. As will be described in greater detail, the bearing housing and the slip clutch are operatively associated with a one-way bearing. The bearing housing and the slip clutch are selectively, rotatably coupled with respect to each other by the one-way bearing. In use, the one-way bearing includes an outer raceway and an inner raceway. The outer raceway is mechanically-rotatably coupled to the bearing housing, and hence, the motor drive shaft and the drive motor. The inner raceway is mechanically-rotatably coupled with respect to the slip clutch, and hence, the covering drive shaft. The outer raceway is adapted and configured to selectively rotate with respect to the inner raceway so that, when viewed from the left side of FIG. 2, when the outer raceway 252 rotates in the clockwise direction CW (e.g., the equivalent of the inner raceway 260 rotating in the counter-clockwise direction CCW), the outer and inner raceway 252, 260 lock together and thus, rotate in unison (e.g., rotation from the outer raceway 252 is transmitted to the inner raceway 260). Alternatively, when the outer raceway 252 rotates in the counter-clockwise direction CCW (e.g., the equivalent of the inner raceway 260 rotating in the clockwise direction CW), the outer and inner raceways 252, 260 rotate freely with respect to each other to decouple from each other so that rotation of the outer raceway 252 is not transmitted to the inner raceway 260 and vice-versa.

In this manner, the dual mode operation system may selectively couple the drive motor to the covering drive shaft to drive (e.g., rotate) the covering drive shaft to retract the covering when the drive motor is operated in a first direction, and to act as a speed governor in the second direction without directly driving the covering drive shaft so that gravity (or another force) can lower or otherwise extend the covering when the drive motor is operated in the second direction. That is, the dual mode operation system transmits a rotational force from the drive motor to the covering drive shaft to retract the covering, but does not transmit a rotational force of the drive motor to the covering drive shaft to extend the covering. In some examples, as will be described in greater detail below, when the covering is being lowered via operation of the motor, the covering is lowered as a result of the weight of the covering exceeding such forces as a spring force from a spring motor and a resistive force from the drive motor since the resistive force is being reduced/eliminated by the dual mode operation system (e.g., by operating the drive motor in a direction that would lower the covering). Meanwhile, the dual mode operation system is also adapted and configured to allow a person to manually (without operating the drive motor, e.g., by hand) operate the architectural structure covering by pulling the covering to lower the covering, and/or lifting the covering to raise the covering without imparting any rotation onto the drive motor. During manual operation, a spring motor may assist the user to raise the covering. That is, in use, the spring motor rotates the covering drive shaft causing the covering and lift system (e.g., covering material, cords, etc.) to be collected while the covering is being raised.

The dual mode operation system may also include a sensor system to identify the location of the covering at all times, whether the position of the covering is adjusted manually or via the motor. For example, a portion of the sensor system may be located on, or rotationally coupled with respect to, the covering drive shaft so that a position sensor can rotate independent of the coupling between the inner and outer raceways of the one-way bearing. In one example embodiment, the sensor system may include a magnet located on, or rotationally coupled with respect to, the covering drive shaft so that the magnet can rotate with the rotation of the covering drive shaft. The rotation of the magnet may be monitored by a Hall effect sensor to determine the position of the covering. In some such example, by coupling the sensor (e.g., magnet) to the covering drive shaft, the sensor rotates irrespective of whether the covering is being moved by the motor or manually, and thus, rotation of the sensor can be monitored regardless if the covering is being driven by the drive motor or by manual movement driven by a force applied other than the motorized force (e.g., by a user pulling on or lifting the covering)).

Figure 2:
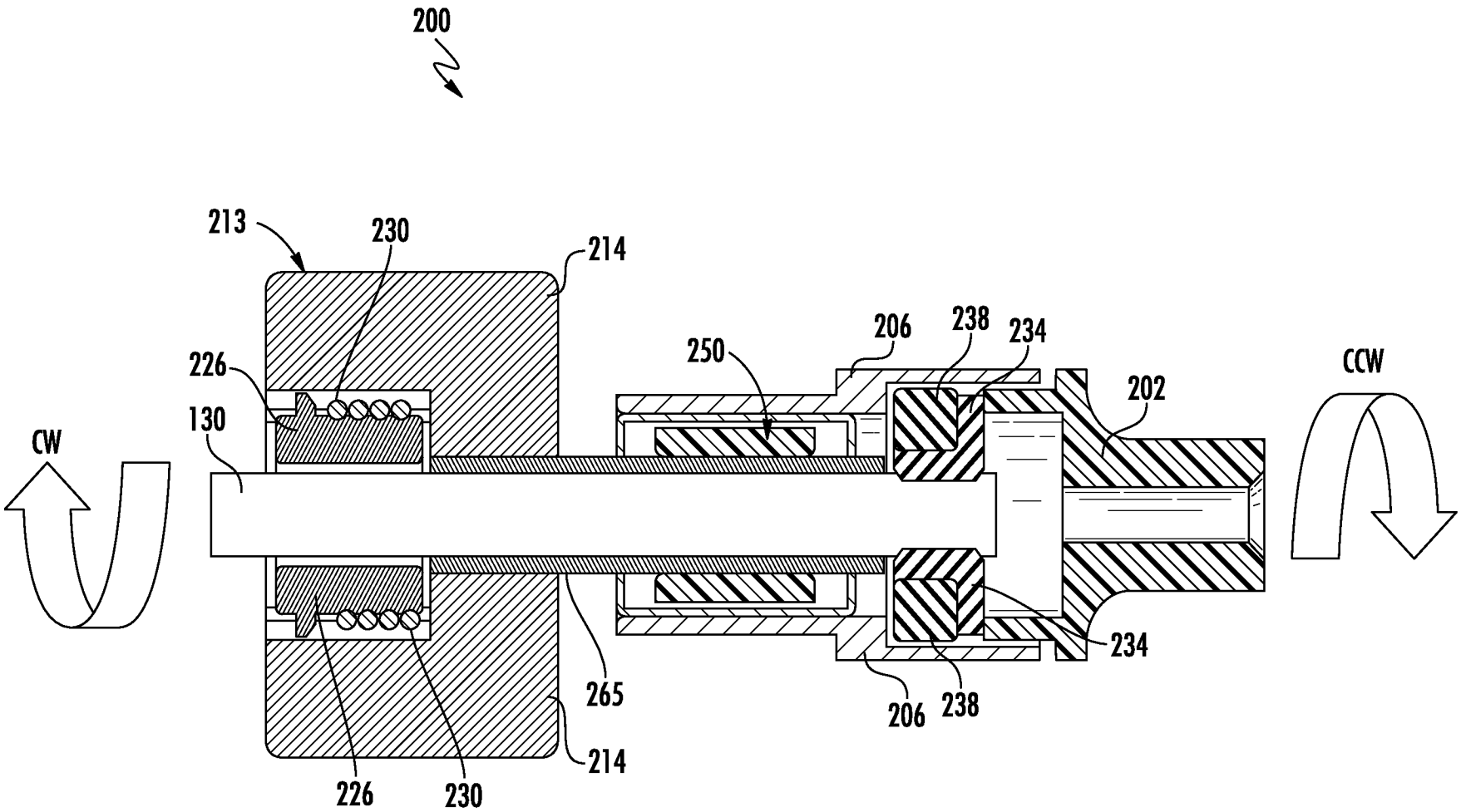
FIG. 2 illustrates a cross-sectional view of an example embodiment of a dual mode operation system which may be used in connection with the covering illustrated in FIG. 1.

Referring to FIGS. 1 and 2 an example embodiment of a dual mode architectural structure covering 100 is illustrated. As shown, the example dual mode architectural structure covering 100 includes a drive motor 160 having a motor drive shaft that has an axis of rotation that is parallel to an axis of rotation of a covering drive shaft 130 of the dual mode architectural structure covering 100. For example, the dual mode architectural structure covering 100 may be a vertically adjustable covering 122 that can be raised and lowered. For example, a stackable covering material 122 that stacks on a rail 124 when the rail 124 is raised or lifted. Stackable coverings generally include a rotatable drive member such as a covering drive shaft, also commonly referred to as a drive rod or a v-shaft. It will be appreciated that the principles described herein may be applied to other types of covering assemblies including, for example, a roller shade or covering, a slotted covering, an aluminum blind, a slotted wood blind, etc. As will be described in greater detail below, the dual mode architectural structure covering 100 may also be used in combination with a roller covering or shade as illustratively shown in FIG. 17.

The example dual mode architectural structure covering 100 illustrated in FIG. 1 includes a covering 122, a rail 124 coupled to a bottom of the covering 122, a covering drive shaft 130, one or more cord spools 140, 142, a spring motor 150, a drive motor 160, electronics 170 for controlling the drive motor 160, and a dual mode operation system 200.

The covering 122 may be constructed with any type of material (e.g., fabric, plastic, vinyl, wood, metal, etc.). Furthermore, the covering 122 may be any type of covering (e.g., stackable style, cellular style, slats, pleated, hurricane shutter, gate, roller, etc.). According to the example embodiment of FIG. 1, the covering 122 is a stackable style fabric. The covering 122 may also include a rail 124 coupled to the fabric at thereof. The covering 122 may also include first and second cord spools 140, 142 coupled to the fabric at or near the bottom thereof by first and second cords 141, 143, respectively. In use, the first and second cords 141, 143 may extend from the first and second cord spools 140, 142, respectively, through the material of the covering 122 to the optional rail 124. Alternatively, if a rail 124 is not used, the first and second cords 141, 143 may couple directly to the fabric. Thus, when the cord spools 140, 142 are wound to take up the cords 141, 143, respectively, the rail 124 and the covering 122 are lifted to reveal an architectural structure (e.g., a window, a door, a wall, an opening, etc.) covered by the covering 122. Although the example dual mode architectural structure covering 100 has been illustrated and described as incorporating first and second cord spools 140, 142, it is contemplated that the covering 122 may include more or fewer spools.

Alternatively, the architectural structure covering may be in the form of a Top-Down, or Top-Down and Bottom-Up operation. In this embodiment, the same lift system is attached to a rail at the top of the shade. In the Top-Down embodiment, a middle rail is able to be movably positioned while the bottom rail stays stationary. The lift system is attached only to the middle rail. The bottom rail remains stationary and hangs via static cords from the top rail. Meanwhile, in the Top-Down/Bottom-Up embodiment, both the middle rail and the bottom rail are able to be movably positioned. In this embodiment, first and second lift systems are incorporated. The first lift system is coupled to the middle rail while the second lift system is coupled to the bottom rail.

The rail 124 may be any member defining a bottom of the covering 122. The rail 124 may be any rigid or semi-rigid member located at the bottom end of the covering 122. For example, the rail 124 may be a bottom bar, a steel rod, a hem bar sewed into the fabric, a rigid bottom pleat of the fabric, etc. The rail 124 may be provided for any one of a variety of reasons including, but not limited to, providing a touch-point (e.g., an element which the user can grasp to move (e.g., raise or lower) the covering 122, in this manner, a person can grasp the rail 124 instead of the covering 122 to prevent damage to the covering 122, to prevent getting the covering 122 dirty, etc.), providing a finished look, to add weight, for example, in weighted coverings (e.g., covering where the weight of the covering and/or rail is used to lower the covering), etc. In weighted coverings 122, the rail 124 may be any material or combination of materials that adds weight to a bottom end of the covering 122. For example, the rail 124 may be a metal bar that is mechanically coupled to a bottom edge of the covering 122. Alternatively, the rail 124 may be coupled to the covering 122 by any other means now known or hereafter developed. The additional weight of the rail 124 may stretch the covering 122 (e.g., to prevent bunching of the covering 122) and may add additional weight to the covering 122 to apply an unwinding force on the covering drive shaft 130 (e.g., as described in greater detail herein). Alternatively, the rail 124 may be omitted.

Generally speaking, a drive shaft 130 is used to impart torque to the covering such as, via an operating element, which causes the covering 122 to retract or extend the covering 122, such as by raising or lowering the covering 122 with respect to the architectural structure. The drive shaft can be any type of drive shaft used to impart torque. For example, the drive shaft could be any shaft for imparting torque to cause lift cords of a stacking-type covering to extend or to retract. For example, such shaft can be configured to receive cord spools, spring motors, etc. on the outer surface thereof and to impart torque thereto. Alternatively, as described in connection with FIG. 17, the drive shaft could be a tube (such as that receives the components therein) which rotates to cause a covering to extend or to retract. In a stacking shade utilizing lift cords 141, 143, which wrap around cord spools 140, 142 to raise the covering 122, and unwrap from the cord spools 140, 142 to allow the covering 122 to lower, the covering drive shaft 130 may be any type of shaft to couple the first and second cord spools 140, 142 to selected components of the dual mode operation system 200. For example, the covering drive shaft 130 may be coupled to cause the first and second cord spools 140, 142 to effect extension or retraction of the covering 122. In the example embodiment of FIG. 1, rotation of the first and second cord spools 140, 142 causes lift cords 141, 143, respectively, either to wrap therearound to bring a free end (e.g., a bottom end or rail 124) of the covering 122 closer to the first and second cord spools 140, 142, thereby retracting the shade, or to unwrap therefrom to allow the free end of the covering 122 to move away from the first and second cord spools 140, 142, thereby extending the shade. The covering drive shaft 130 may also be commonly referred to as a v-rod or lift rod. The covering drive shaft 130 illustrated in the embodiment of FIG. 1 is a metal shaft configured to engage at least one component of the operating system of the shade to rotate therewith, and/or to engage with at least one component of the dual mode operation system 200 to rotate therewith. In one example, the covering drive shaft 130 may be substantially cylindrical except for a V-shaped groove that runs along the length of the covering drive shaft 130 to couple the covering drive shaft 130 to matching inverted V-shaped tangs in the first and second cord spools 140, 142 and selected components of the dual mode operation system 200. Alternatively, the covering drive shaft 130 may be any type of shaft that can transmit rotational force (e.g., by engagement or interlocking) to another element (e.g., a shaft having a square profile, a shaft having a triangular profile, a substantially cylindrical shaft on which components are fixed (e.g., using a mechanical or chemical fastener), etc.).

The cord spools 140, 142 include spools to take up cords 141, 143, respectively, coupled to the bottom or near the covering material 122, such as via the rail 124. For example, the cords 141, 143 may lift the rail 124 and, thereby, the covering 122, as the cords 141, 143 are taken up/wound by the cord spools 140, 142, respectively. Accordingly, rotation of the covering drive shaft 130 drives rotation of the first and second cord spools 140, 142 and rotation of the first and second cord spools 140, 142 drives rotation of the covering drive shaft 130 (e.g., when a person pulls the covering 122 away from the cord spools 140, 142).

The spring motor 150 is spring-loaded to apply a rotational force in one direction. The spring motor 150 can be any type of spring motor now known or hereafter developed including, for example, those described in U.S. Pat. No. 8,230,896 entitled Modular Transport System for Coverings for Architectural Openings. In the example embodiment of FIG. 1, the spring motor 150 applies a rotational force in a direction that raises the covering 122. The combined weight of the covering 122 and the rail 124 counters the rotational force of the spring motor 150. Thus, in its neutral position, the combined weight of the covering 122 and the rail 124 along with miscellaneous frictional forces counterbalances the upward rotational force of the spring motor 150 leaving the covering 122 in its desired position. When the upward force is increased (e.g., when a user lifts the covering 122 and/or the rail 124), the other downward forces on the covering 122 are overcome and the rotational force from the spring motor 150 is able to cause the covering drive shaft 130 to rotate and draw up or wind any loose cord 141, 143 on the first and second cord spools 140, 142, respectively. In the illustrated embodiment, the spring motor 150 is positioned between the first and second cord spools 140, 142 on the covering drive shaft 130. Alternatively, the spring motor 150 could be positioned at any other position on the covering drive shaft 130 including, for example, at an end of the covering drive shaft 130.

The drive motor 160 is an electric motor coupled to the covering drive shaft 130 via the dual mode operation system 200. The electric motor 160 may be any motor used to translate electrical energy into a rotational force at an output of the electric motor. The drive motor 160 may include gearing to adjust the torque and rotational speed of the output of the drive motor 160. For example, the drive motor 160 may include a gearbox to slow the output of the drive motor 160 and to increase the torque at the output of the drive motor 160. Alternatively, if the output of the drive motor 160 is appropriate for a particular implementation, a gearbox may be omitted. According to the example embodiment illustrated in FIG. 1, the drive motor 160 is physically and electrically coupled and/or attached to electric circuitry or electronics 170. Alternatively, the drive motor 160 may be coupled with the electronics 170 in any other manner.

The electronics 170 in some embodiments include power circuitry for powering the drive motor 160 and control circuitry for signaling operation of the drive motor 160 (e.g., in response to control signals received from an integrated input, a wired remote controller, a wireless remote controller, etc.).

Referring to FIGS. 2 and 7A-16B, an example embodiment of the dual mode operation system 200 is illustrated. As shown, the dual mode operation system 200 includes a motor mount 202, a bearing housing 206, a one-way bearing 250 at least partially disposed within the bearing housing 206, and a slip clutch 213. The motor mount 202 is sized and configured to engage a drive motor (e.g., the drive motor 160 of FIG. 1) or another rotational driver (e.g., an output of a non-motorized rotational driver such as a manual controller). The motor mount 202 is mechanically-rotatably coupled to the bearing housing 206 so that the motor mount 202 and the bearing housing 206 rotate together (rotation of one results in rotation of the other). That is, as illustratively shown in FIGS. 7A-13 and 15A-16B, the bearing housing 206 may include a plurality of projections 207 for engaging corresponding recesses 203 formed in the motor mount 202, although other means for coupling the bearing housing 206 to the motor mount 202 are contemplated. Accordingly, rotation of the motor mount 202 (e.g., by the drive motor 160) drives rotation of the bearing housing 206. The motor mount 202 may be any type of motor coupling for coupling the dual mode operating system 200 to a drive motor. The motor mount 202 may directly engage the drive motor 160 or may be coupled to an output shaft of the drive motor 160.

Figure 10:
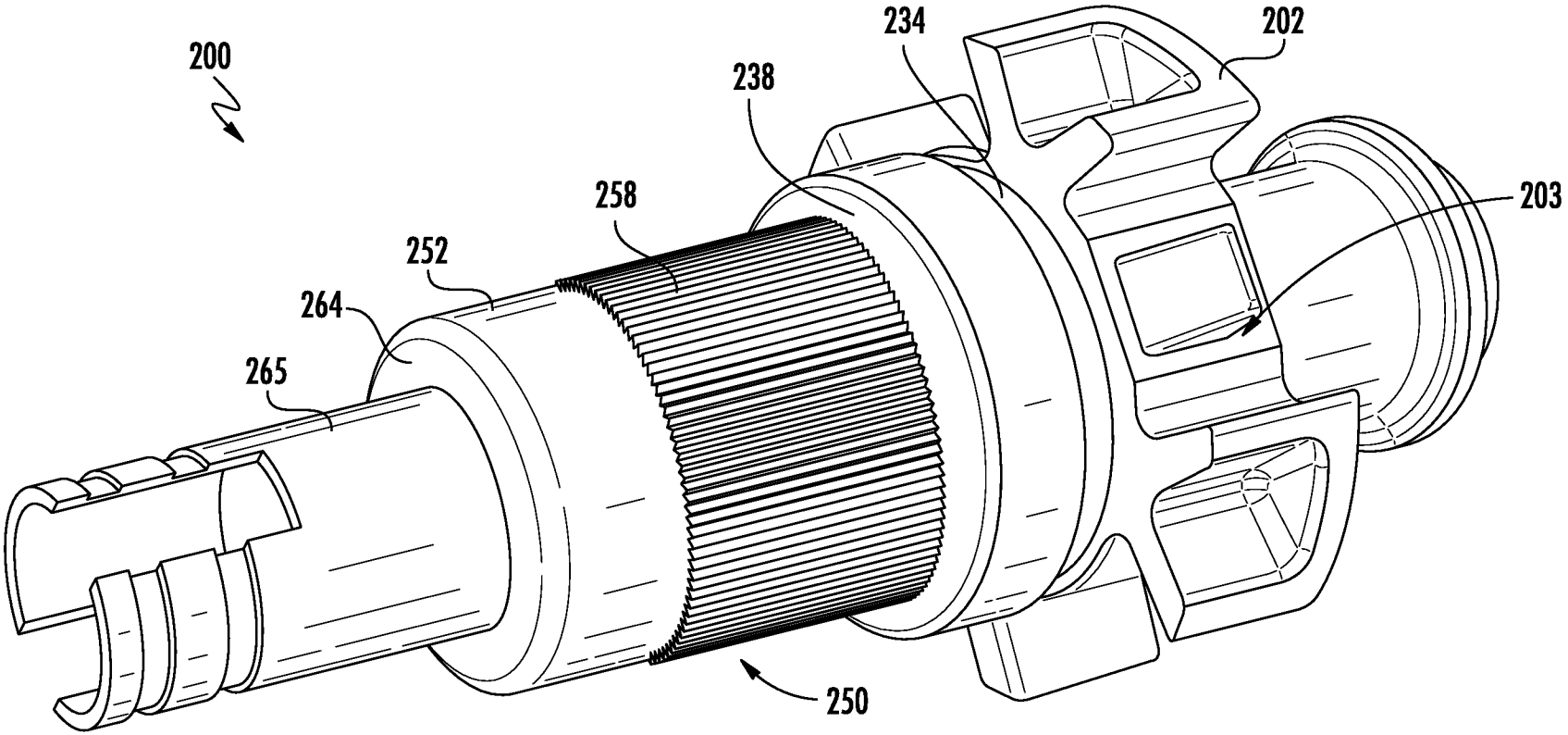
FIG. 10 illustrates a front perspective view of the example embodiment of the dual mode operation system of FIG. 2 with the bearing housing and the slip clutch removed.
Figure 11:
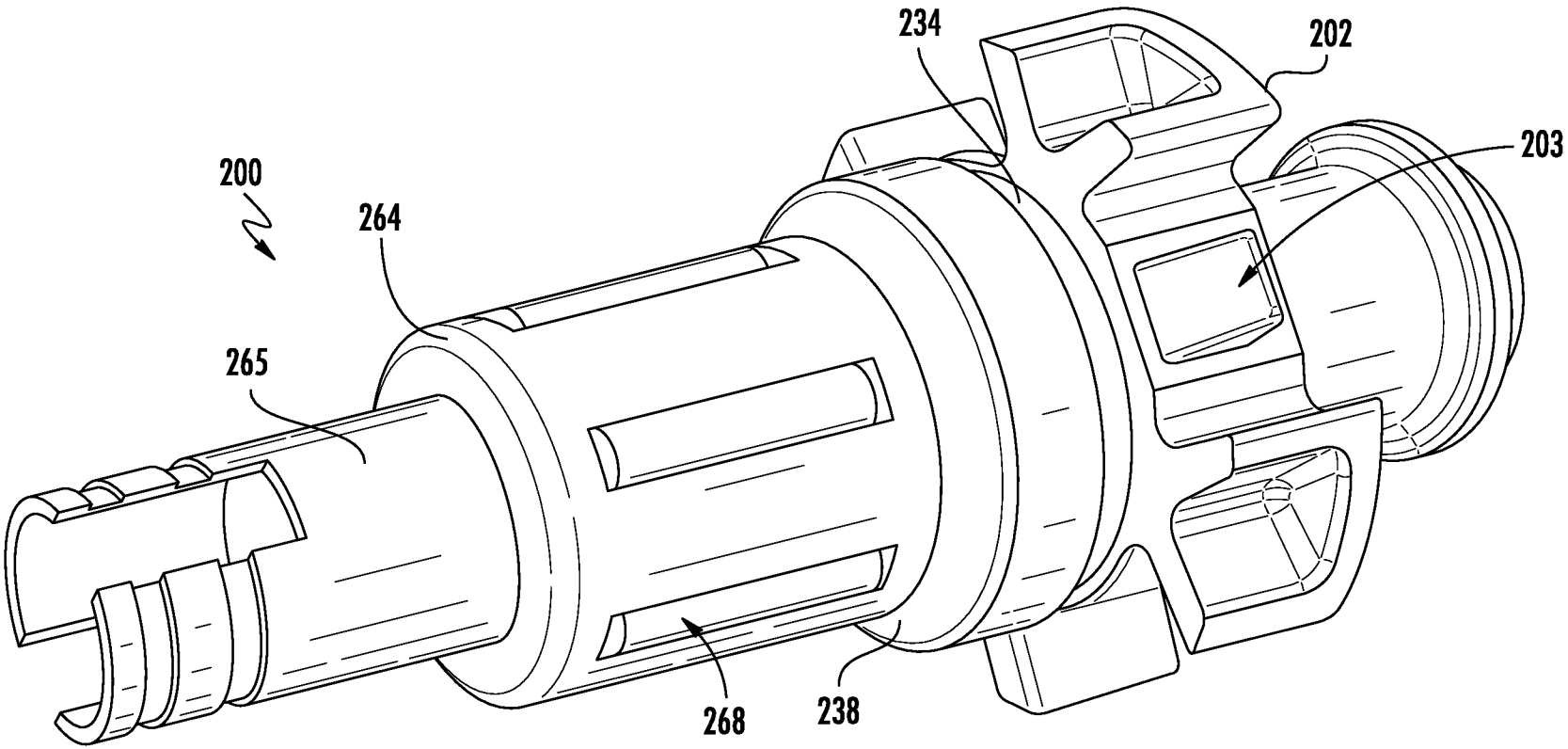
FIG. 11 illustrates a front perspective view of the example embodiment of the dual mode operation system of FIG. 2 with the bearing housing, the slip clutch and the outer raceway removed.
Figure 12:
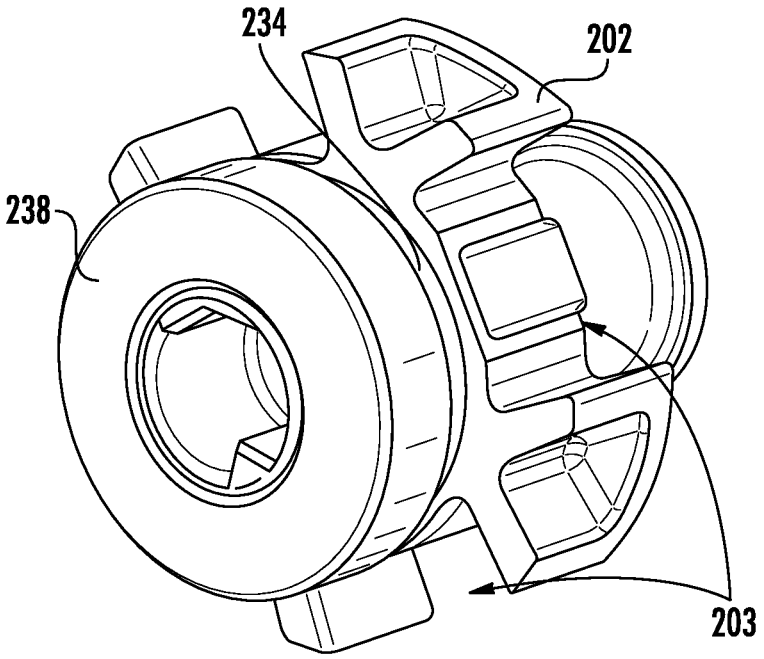
FIG. 12 illustrates a front perspective view of an example embodiment of the sensor system and motor mount used in connection with the dual mode operation system of FIG. 2.
Figure 13:
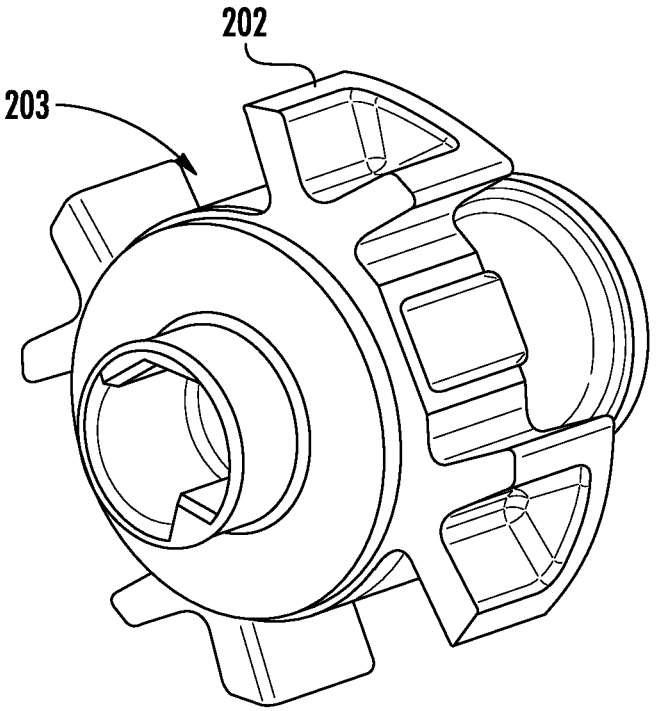
FIG. 13 illustrates a rear perspective view of the example embodiment of the sensor system (minus the magnet) and motor mount of FIG. 12.

The bearing housing 206 extends from its coupling with the motor mount 202 to at least partially surround and be coupled with the one-way bearing 250. Referring to FIGS. 8A, 8B, 10 and 14, the one-way bearing 250 includes an outer raceway 252 and an inner raceway 260. As best shown in FIGS. 2, 10 and 11, the inner raceway 260 may be deemed to be formed along a portion of a transfer shaft 265. Alternatively, the inner raceway 260 may be separately formed and coupled to the transfer shaft 265. The inner raceway 260 may have a length substantially corresponding to the length of the outer raceway 252. The one-way bearing 250 may also include a separator or cage 264 located between the outer raceway 252 and the inner raceway 260. As will be described in greater detail below, the separator or cage 264 includes grooves or slots 268 for rotationally holding bearing elements such as rollers 270 so that the outer raceway 252 can rotate with respect to the inner raceway 260. That is, the grooves or slots include a first (e.g., contact) surface on one side-surface thereof and a second (e.g., ramped or wedge) surface on the opposite side surface so that movement of the outer raceway relative to the inner raceway in the direction of the first surface allows the longitudinal rollers 270 to rotate and thus allow the outer raceway to freely rotate with respect to the inner raceway. Meanwhile, movement of the outer raceway relative to the inner raceway in the direction of the second surface prohibits the longitudinal rollers 270 from rotating (such as by wedging the bearing elements against the inner raceway and/or the outer raceway to lock the inner raceway and outer raceway from rotating with respect to each other) and thus causes the outer raceway to lock with respect to the inner raceway. Alternatively, it is contemplated that the inner raceway 260 and the transfer shaft 265 may be integrally formed.

The outer raceway 252 has an outer surface 254. The bearing housing 206 may be coupled to the outer raceway 252 of the one-way bearing 250 by any means now known or hereafter developed that enables the bearing housing 206 to rotate with the outer raceway 252 including, but not limited to, a mechanical fastener, a chemical fastener, a press-fit connection, etc. As shown, the outer surface 254 may include a plurality of serrations or projections 258 for engaging the bearing housing 206. Accordingly, rotation of the bearing housing 206 (e.g., driven by rotation of the motor mount 202 by the drive motor 160) rotates together with the one-way bearing 250.

The transfer shaft 265 may be coupled to the inner raceway 260 of the one-way bearing 250 by any means now known or hereafter developed including, but not limited to, forming a plurality of serrations or projections on the shaft for engaging the inner surface of the inner raceway, interlocking projections and recesses, a mechanical fastener, a chemical fastener, a press-fit connection, etc. or as previously mentioned, they could be integrally formed. Accordingly, rotation of the transfer shaft 265 rotates the inner raceway 260.

In addition, the transfer shaft 265 may extend longitudinally beyond the one-way bearing 250 so that the exposed end of transfer shaft 265 may couple with a slip clutch 213. In use, the transfer shaft 265 transfers rotational forces between the one-way bearing 250 and the slip clutch 213. The transfer shaft 265 may be hollow or include a hollow portion therein for receiving a portion of the covering drive shaft 130 therein. The slip clutch 213 and the transfer shaft 265 may be rotatably coupled to each other by any means now known or hereafter developed including, but not limited to, a mechanical fastener, a chemical fastener, interlocking projections and recesses, a plurality of serrations or projections, a press-fit, etc. In this manner, the slip clutch 213 and the transfer shaft 265 may rotate together. As will be described in greater detail below, the slip clutch 213 includes a hub 226. The hub 226 is rotationally coupled to the covering drive shaft 130. The coupling of the covering drive shaft 130 to the slip clutch 213 results in the rotation of the covering drive shaft 130 to be transmitted through the slip clutch 213 to the inner raceway 260 via the transfer shaft 265, which is rotationally coupled to the inner raceway 260.

The outer and inner raceways 252, 260 form a one-way bearing that transmits rotation from the outer raceway 252 to the inner raceway 260 (and vice versa) in a first direction of rotation, for example, when the outer raceway 252 rotates in the counter-clockwise direction CCW relative to the inner raceway 260 and the inner raceway 260 rotates in the clockwise direction CW relative to the outer raceway 252. Similarly, rotation is not transmitted between the outer and inner raceways 252, 260 when the outer raceway 252 and the inner raceway 260 rotate in a second relative direction of rotation, for example, when the outer raceway 252 rotates in the clockwise direction CW relative to the inner raceway 260 and the inner raceway 260 rotates in the counter-clockwise direction CCW relative to the outer raceway 252. That is, as will be described, when viewed from the left side of FIG. 2, the outer raceway 252 is adapted and configured to selectively rotate with respect to the inner raceway 260 when the outer raceway 252 rotates in the clockwise direction CW relative to the inner raceway 260 (e.g., the equivalent of the inner raceway 260 rotating in the counter-clockwise direction CCW). The outer and inner raceways 252, 260 lock together and thus, rotate in unison (e.g., rotation from the outer raceway 252 is transmitted to the inner raceway 260) to transmit rotation of the motor mount 202 from the drive motor 160 to the covering drive shaft 130, as will be described in further detail below. Alternatively, when the outer raceway 252 rotates in the counter-clockwise direction CCW relative to the inner raceway 260 (e.g., the equivalent of the inner raceway 260 rotating in the clockwise direction CW), the outer and inner raceways 252, 260 rotate freely with respect to each other to decouple from each other so that rotation of the outer raceway 252 is not transmitted to the inner raceway 260 and vice-versa, and rotation of the motor mount 202 from the drive motor 160 does not cause rotation of covering drive shaft 130.

Figure 14:
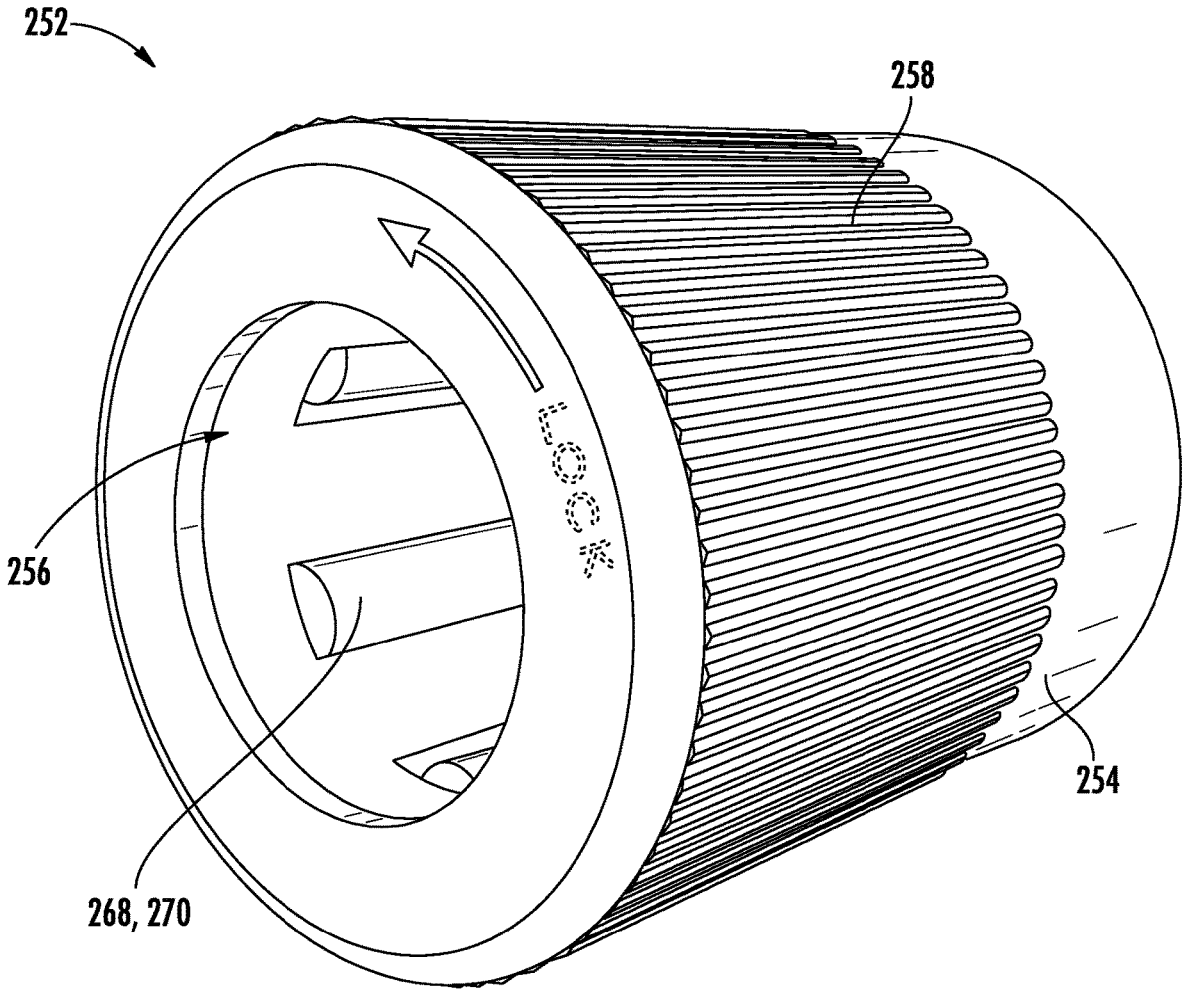
FIG. 14 illustrates a perspective view of an example embodiment of the outer raceway used in connection with the dual mode operation system of FIG. 2.
Figure 15A:
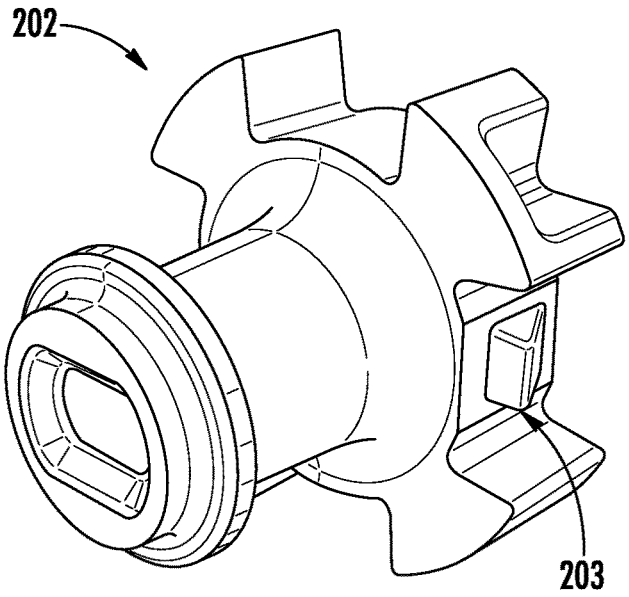
FIG. 15A illustrates a rear perspective view of an example embodiment of the motor mount used in connection with the dual mode operation system of FIG. 2.
Figure 15B:
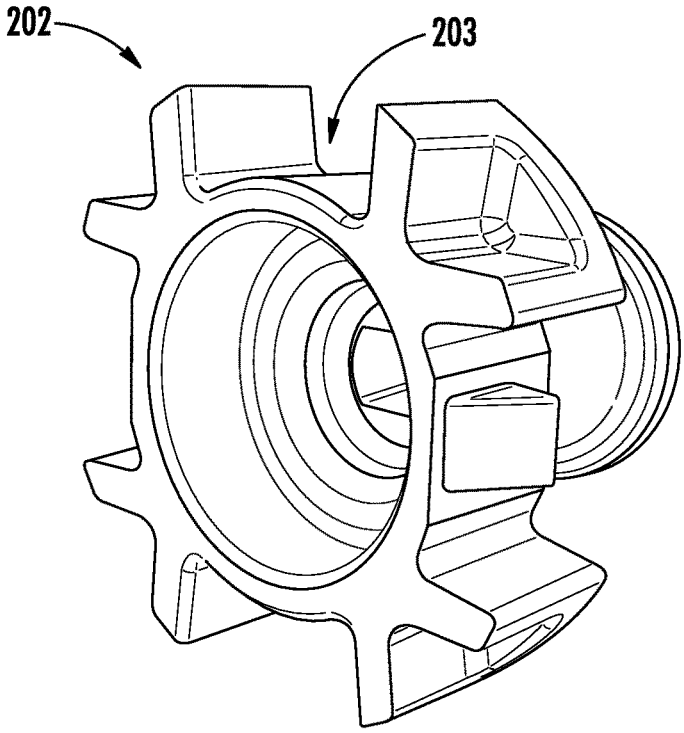
FIG. 15B illustrates a front perspective view of an example embodiment of the motor mount used in connection with the dual mode operation system of FIG. 2.
Figure 16A:
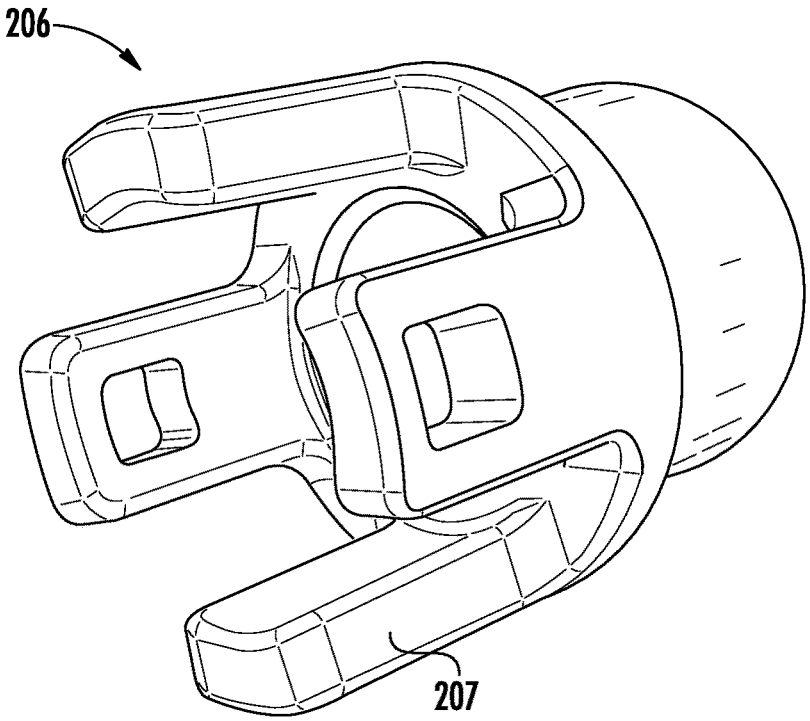
FIG. 16A illustrates a front perspective view of an example embodiment of the bearing housing used in connection with the dual mode operation system of FIG. 2.
Figure 16B:
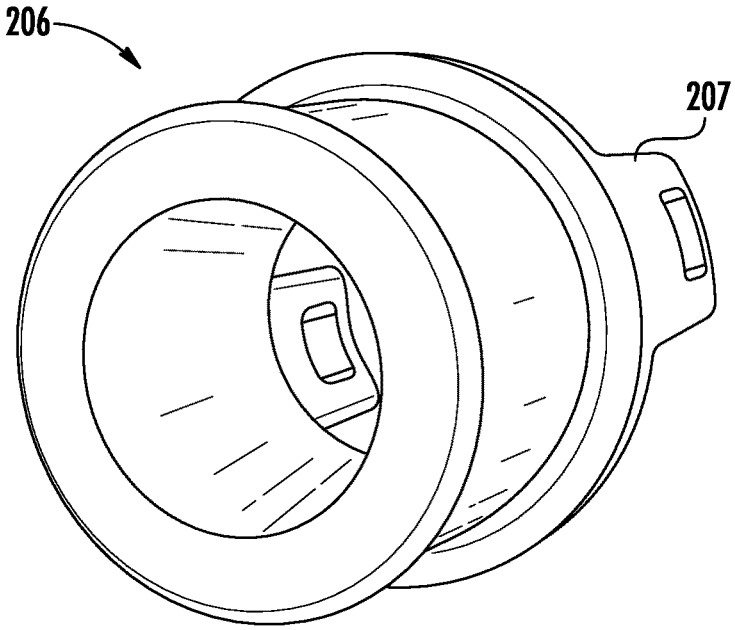
FIG. 16B illustrates a rear perspective view of an example embodiment of the bearing housing used in connection with the dual mode operation system of FIG. 2.

Referring to FIGS. 2, 11 and 14, the one-way bearing 250 may include bearing elements such as cylindrical rollers 270, circumferentially disposed between the outer and inner raceways 252, 260. For example, the one-way bearing 250 may include a bearing separator or cage 264 located in-between the outer and inner raceways 252, 260. The cage 264 may be adapted and configured to receive and hold the bearing elements in place. The cage 264 may also provide the structure that creates the one-way operation. For example, the cage 264 may include the first (e.g., contact) surface on one side-surface thereof and the second (e.g., ramped or wedge) surface on the opposite side surface so that movement of the outer raceway relative to the inner raceway in the direction of the first surface allows the longitudinal rollers 270 to rotate and thus allow the outer raceway to freely rotate with respect to the inner raceway. Meanwhile, movement of the outer raceway relative to the inner raceway in the direction of the second surface prohibits the longitudinal rollers 270 from rotating (such as by wedging the bearing elements against the inner raceway and/or the outer raceway to lock the inner raceway and outer raceway from rotating with respect to each other) and thus causes the outer raceway to lock with respect to the inner raceway. As shown, the cage 264 may include a plurality of grooves 268, notches etc. for receiving the cylindrical rollers 270 therein. The grooves 268 and rollers 270 are adapted and configured to lock or couple the outer raceway 252 to the inner raceway 260 when the outer raceway 252 is rotated in the counter-clockwise direction CCW relative to the inner raceway 260 (or first direction). The grooves 268 and rollers 270 are adapted and configured to permit free rotation or decoupling of the outer raceway 252 from the inner raceway 260 when the outer raceway 252 is rotated in the clockwise direction CW relative to the inner raceway 260 (or second direction). While the one-way bearing 250 has been described as including circumferentially disposed cylindrical rollers 270 in between the outer and inner raceways 252, 260, it is contemplated that other bearings may be used, for example, ball-bearings, etc. In addition, while the one-way bearing 250 has been described as being of the roller bearing type, it is contemplated that any other type of one-way bearing may be used. For example, the inner raceway 260 may be associated with a pawl to engage a ratchet formed on the inner surface 256 of the outer raceway 252, alternatively, the outer raceway 252 may be associated with a pawl to engage a ratchet formed on the outer surface of the inner raceway 260, to rotationally lock the outer raceway 252 with respect to the inner raceway 260 in the first direction and, in the second direction, the pall may not engage the ratchet (e.g., may slip past the ratchet) to disengage or decouple the outer raceway 252 from the inner raceway 260 (as described for example in United States Patent Application No. 2014/0224437 entitled Control of Architectural Opening Coverings).

Turning to the operation of the outer and inner raceways 252, 260, when the outer raceway 252 is rotated in the first direction (e.g., rotated when the drive motor 160 rotates the motor mount 202, which rotates the bearing housing 206), the outer raceway 252 engages the inner raceway 260 via the interaction between the longitudinal rollers 270 and the plurality of grooves 268 formed in the inner surface 256 of the outer raceway 252 and the outer surface of the separator or cage 264 to rotationally couple the inner raceway 260 with respect to the bearing housing 206 and, thereby, the motor mount 202, so that rotation of the drive motor 160 drives rotation of the inner raceway 260 in the first direction. When the outer raceway 252 is rotated in the second direction (e.g., when drive motor 160 rotates the motor mount 202 and hence the outer raceway 252 in the second direction), the outer raceway 252 rotates freely with respect to and effectively decouples from the inner raceway 260 so that rotation of the motor mount 202, the bearing housing 206, and the outer raceway 252 does not rotate the inner raceway 260. Thus, the outer raceway 252 decouples the output of the drive motor 160 (coupled to rotate the motor mount 202) from the inner raceway 260 to prevent the drive motor 160 from driving rotation of the inner raceway 260 in the second direction. In one embodiment, when the drive motor 160 rotates the motor mount 202 in the first direction, the outer raceway 252 engages the inner raceway 260 to drive rotation of the inner raceway 260 in the first direction, which may raise the covering 122, and when the drive motor 106 rotates the motor mount 202 in the second direction, the outer raceway 252 rotates freely with respect to the inner raceway 260 so that the covering 122 may lower freely without the drive motor 160 driving the covering drive shaft 130 to lower the covering 122, as will be described in further detail below.

As mentioned, in one example embodiment the dual mode operation system 200 also includes a slip clutch 213. In general, the slip clutch 213 may be used to provide a braking force to one or more aspects of the system. In the embodiment of the slip clutch 213 in FIG. 2, the slip clutch 213 includes a slip clutch housing 214, a hub 226, and a spring 230. The inner raceway 260 is mechanically-rotatably coupled with respect to the slip clutch 213. Specifically, the inner raceway 260 is mechanically-rotatably coupled to the slip clutch housing 214 to rotate therewith via the transfer shaft 265.

To provide braking and to allow slippage between rotation of the covering drive shaft 130 and the transfer shaft 265 as desired, the slip clutch 213 includes a hub 226 and a spring 230 (e.g., a wrap spring or coil spring). The hub 226 and the spring 230 in some embodiments are located at least partially within the slip clutch housing 214. The spring 230 may be coupled to the slip clutch housing 214 by any means now known or hereafter developed. For example, the spring 230 may include a tang at a first end thereof for engaging the slip clutch housing 214. The spring 230 is wrapped around the hub 226 to be frictionally coupled with the hub 226. As previously mentioned, the hub 226 may include a key surface for mating with a groove (e.g., a V-shaped groove) in the covering drive shaft 130 to rotatably couple the covering drive shaft 130 with respect to the hub 226. Alternatively, any other means for coupling the hub 226 to the covering drive shaft 130 may be used including, but not limited to, a mechanical fastener (e.g., a set screw), a chemical fastener, interlocking projections and recesses, a press-fit, etc. When a rotational force is applied to the hub 226 by the covering drive shaft 130 that exceeds the frictional holding force of the spring 230, the hub 226 will rotate even while the slip clutch housing 214 remains stationary, and hence while the inner raceway 260, the outer raceway 252, the bearing housing 206, and the motor mount 202 remain stationary. For example, when the dual mode operation system 200 is implemented in the architectural structure covering, the spring 230, in combination with the spring motor 150, provides sufficient holding force to ensure that a combined weight of the covering 122 and the rail 124 does not lower the covering 122 (e.g., under the force of gravity) when the slip clutch housing 214 is held stationary (e.g., the slip clutch 213 remains engaged). However, the spring 230 provides a sufficiently weak holding force to ensure that a user can overcome the holding force of the spring 230 by pulling/raising the covering 122 and/or the rail 124 to lower/extend the covering 122 without tearing the covering 122 or otherwise damaging the architectural structure covering 100, as noted above, and in further detail below. As such, the one-way bearing 250 causes the inner raceway 260 to be rotationally locked with respect to the outer raceway 252 and hence the drive motor 160, when the spring 230 applies a holding force greater than a combined weight of the covering 122 and the rail 124. However, when an additional force is applied, the spring force of the slip clutch 213 can be overcome so that the covering drive shaft 130 can rotate with respect to the inner raceway 260, the spring 230 allows the hub 226 to rotate with respect to the slip clutch housing 214.

Together, the slip clutch housing 214, the hub 226, and the spring 230 form the slip clutch 213, although other type of devices are contemplated including, but not limited to, a disc brake, a brake pad, or any other type of brake. According to the example embodiment, the braking force of the slip clutch 213 is designed to be overcome (e.g., to slip) due to manual (e.g., non-motorized) rotation of the covering drive shaft 130.

In operation, during manual operation to lower the covering 122, for example, by pulling the covering 122 and/or the rail 124 downward, causes the covering drive shaft 130 to rotate in the counter-clockwise direction CCW (when viewed from the left side of FIG. 1). As will be described in greater detail below, counter-clockwise rotation CCW of the covering drive shaft 130 causes the slip clutch 213 (e.g., the hub 226, spring 230 and slip clutch housing 214) to rotate, which causes the transfer shaft 265 and the inner raceway 260 to all rotate in the counter-clockwise direction. Rotation of the inner raceway 260 in the counter-clockwise direction relative to the outer raceway 252, causes the outer raceway 252 to lock with respect to the inner raceway 260. As such, the outer raceway 252, the bearing housing 206, and the motor mount 202 all rotate in unison. However, since the drive motor 160 is not operated, the drive motor 160 applies a resistive holding force to the motor mount 202 preventing it from rotating. Thus, if the force applied by the rotation of the covering drive shaft 130 exceeds that of the slip clutch 213, which has a braking force that is less than the resistive holding force of the drive motor 160, the covering drive shaft 130 and the hub 226 will rotate with respect to the spring 230 and the slip clutch housing 214, thereby decoupling the rotation of the covering drive shaft 130 from the drive motor 160. Accordingly, the covering drive shaft 130 rotates while the drive motor 160 is not operated and/or is stationary.

More specifically, when the drive motor 160 is not operating, the covering 122 and/or the rail 124 are subjected to a gravitational force, which applies a rotational force to the covering drive shaft 130 in the unwinding direction (e.g., counter-clockwise direction). The rotational force is transmitted from the covering drive shaft 130 to the hub 226 and then to the slip clutch housing 214 via the spring 230. As the transfer shaft 265 is rotationally coupled with respect to the slip clutch housing 214, the transfer shaft 265 and hence the inner raceway 260 are all rotated in the counter-clockwise direction. Counter-clockwise rotation of the inner raceway 260 (or relative to the outer raceway 252) results in the one-way bearing locking together (e.g., the inner raceway 260 locks with respect to the outer raceway 252). As the drive motor 160 is not operating, a resistive holding force of the drive motor 160 (e.g., a resistance to rotation when the drive motor 160 is not engaged via an electrical signal) holds the motor mount 202 and, thus, the bearing housing 206 and the outer raceway 252 stationary.

As long as the holding force of the slip clutch 213 (e.g., approximately 3 pounds) and the resistive holding force of the drive motor 160 (e.g., approximately 5 pounds) both exceed the combined weight of the covering 122 and the rail 124 (e.g., approximately 4 pounds) minus the lifting force of the spring motor 150 (e.g., approximately 1 pound) (e.g., including frictional forces), the resistive holding force of the drive motor 160 is transmitted to the covering drive shaft 130 holding the covering 122 stationary (e.g., the cord spools 140, 142 are held stationary) so that the shade does not creep downwardly and into its extended configuration unintendedly. It will be appreciated that the forgoing values for holding force, weight, lifting force, and frictional force are merely examples, and are not intended to limit the manner in which the dual mode operation system 200 can operate. However, when the external manual force is sufficient to overcome the spring force applied by the spring motor 150 (e.g., when a person pulls on the rail 124 and/or the covering 122), the hub 226 slips with respect to the spring 230 while the slip clutch housing 214 remains stationary. Thus, the covering drive shaft 130 causes the covering 122 to lower, such as by rotating the cord spools 140, 142.

Manual operation to raise the covering 122 causes rotation of the covering drive shaft 130 in the clockwise direction (when viewed from the left side of FIG. 1). Rotation of the covering drive shaft 130 in the winding direction (e.g., clockwise direction (when viewed from the left side of FIG. 1)) moves the covering into a retracted configuration. For example, in one embodiment, a user may lift the covering 122 and/or the rail 124, which may reduce the various downward forces that pull on the cord spools 140, 142 (e.g., from the weight of the rail 124, the weight of the covering material 122, springiness of the covering material resisting compression thereof, etc.). Rotation of the covering drive shaft 130 in the winding direction enables the cord spools 140, 142 to wind the cords 141, 143, respectively, and, hence, the covering into a retracted configuration.

Rotation of the covering drive shaft 130 transmits rotation to the hub 226 to rotate in the clockwise direction, which transmits the rotation to the slip clutch housing 214 via the spring 230. The rotation of the slip clutch housing 214 is transmitted to the inner raceway 260 via the transfer shaft 265, which is rotationally coupled to the slip clutch housing 214. Rotation of the inner raceway 260 in the clockwise direction relative to the outer raceway 252 (or counter-clockwise rotation of the outer raceway 252), causes the outer raceway 252 to rotate with respect to or decouple with respect to the inner raceway 260. As such, clockwise rotation of the inner raceway 260 does not cause the outer raceway 252, the housing 206 or the motor mount 202 to rotate. Accordingly, the covering drive shaft 130 rotates in the clockwise direction decoupled from the attached drive motor 160 and, thus, the rotational force applied by the covering drive shaft 130 is not transmitted to the drive motor 160.

In motorized operation mode, as previously discussed, the dual mode operation system 200 selectively couples an output of the drive motor 160 (e.g., an output from a gearbox of the drive motor 160, a drive shaft of the drive motor 160, etc.) to drive the covering drive shaft 130. Specifically, the dual mode operation assembly 200 allows the drive motor 160 to drive rotation of the covering drive shaft 130 in a first direction that raises covering 122 and prevents the drive motor 160 from driving rotation in a second direction that lowers the covering 122 (e.g., prevents the drive motor 160 from applying a substantial rotational force in the lowering direction).

In one example embodiment, motorized operation to raise the covering 122 causes rotation of the covering drive shaft 130 in the clockwise direction (when viewed from the left side of FIG. 1). Clockwise rotation of the drive motor 160 rotates the motor mount 202, which transmits rotation to the bearing housing 206 (coupled to rotate upon rotation of motor mount 202). Rotation of the bearing housing 206 transmits the rotation to the outer raceway 252. In the clockwise direction of rotation of the outer raceway 252 relative to the inner raceway 260, the outer and inner raceways 252, 260 lock relative to each other so that rotation of the outer raceway 252 causes rotation of the inner raceway 260, which causes rotation of the transfer shaft 265, which is rotationally coupled to the inner raceway 260. Rotation of the transfer shaft 265, which is also rotationally coupled to the slip clutch housing 214, causes rotation of the hub 226 via the spring 230. Rotation of the hub 226 transmits the rotation to the covering drive shaft 130, lifting the covering 122 and/or the rail 124. For example, in one embodiment, rotation of the hub 226 transmits rotation to the covering drive shaft 130, which may drive rotation of the cord spools 140, 142 thereby lifting the covering 122 and/or the rail 124.

Motorized operation to lower the covering 122 causes rotation of the covering drive shaft 130 in the counter-clockwise direction (when viewed from the left side of FIG. 1). Counter-clockwise rotation of the drive motor 160 causes the motor mount 202 to rotate with the bearing housing 206. Rotation of the bearing housing 206 causes the outer raceway 252 to rotate in the counter-clockwise direction relative to the inner raceway 260, which results in the outer raceway 252 rotating freely with respect to and effectively decoupling from the inner raceway 260. Accordingly, the rotation of the outer raceway 252 does not transmit a rotational force to the inner raceway 260. If no other rotational force is applied to the covering drive shaft 130, the outer raceway 252 rotates around the inner raceway 260. In this manner, various downward forces on the covering 122, such as the combined weight of the covering 122 and the rail 124, are free to exert forces sufficient to extend the covering 122, such as by pulling the cords 141, 143 attached to the cords spools 140, 142, respectively, to rotate the covering drive shaft 130 in the unwinding direction (e.g., overcoming the spring force applied by the spring motor 150). During motorized lowering, as long as the outer raceway 252 rotates at a speed greater than or equal to the rotational speed of the inner raceway 260, the outer raceway 252 will rotate counter-clockwise CCW and thus the outer raceway 252 will freely rotate with respect to the inner raceway 260. As such, the inner raceway 260, as a result of the gravitation forces (e.g., combined weight of the covering 122 and the rail 124, etc.) will rotate the inner raceway 260 in a counter-clockwise CCW direction as well. However, if the rotational speed of the outer raceway 252 is less than the rotational speed of the inner raceway 260, the outer raceway 252 will effectively lock with respect to the inner raceway 260 and thus, slow or stop the inner raceway 260 from spinning. As such, the drive motor 160 and/or the one-way bearing 250 may effectively act as a speed governor to govern/limit the speed of rotation of the covering drive shaft 130 (e.g., to provide an aesthetically pleasing lowering speed, and/or to prevent damage to the covering 122 and/or the rail 124).

Referring to FIGS. 2 and 9-12, as previously mentioned, in one example embodiment of the dual mode operation system 200, the system 200 may include a rotation tracking or sensing functionality to track the position of the covering 122. Such functionality can also allow the system to implement upper and lower limits for the covering 122 so that the covering 122 can be moved between fully raised and fully lowered positions. In some embodiments, the electronics 170 may include a sensor 275 used to monitor rotation of the covering drive shaft 130 to monitor a position of the covering 122 (e.g., by tracking rotation from a known point to determine the position of the covering 122). The dual mode operation system 200 may include a magnet 238 to interact with the sensor 275 associated with the electronics 170. In use, the magnet 238 is rotatably coupled with respect to the covering drive shaft 130. As shown the magnet 238 may be coupled to an intermediate member 234 for mechanically-rotatably coupling the magnet 238 with respect to the covering drive shaft 130. In the example embodiment shown in FIG. 2, the intermediate member 234 includes a key surface that mates with a groove (e.g., a V-shaped groove) in the covering drive shaft 130 to rotatably couple the covering drive shaft 130 with respect to the intermediate member 234 so that rotation of the covering drive shaft 130 rotates the intermediate member 234. The magnet 238 is coupled with respect to the intermediate member 234 such that rotation of the covering drive shaft 130 drives rotation of the intermediate member 234 and, thereby, the magnet 238. Thus, any rotation of the covering drive shaft 130, whether it be by manual operation or motorized operation, will drive rotation of the magnet 238, which can be tracked by the sensor 275.

In one example embodiment, the sensor 275 is a Hall effect sensor, although other types of sensors are contemplated including, for example, rotary sensors, gravitational sensors (e.g., accelerometers, gyroscopes, etc.), or any other sensor that can monitor rotation of the covering drive shaft 130 and/or the cord spools 140, 142. Alternatively, any other sensor system for tracking the position of the covering 122 may be used, including, for example, an ultrasonic position sensor, a barometric sensor, a mechanical limit switch/sensor, etc. Alternatively, any other type of position sensing device or combination of components may be utilized. For example, a sensor(s) may be disposed within the dual mode operation system 200, a sensor(s) may be located on a circuit board of the electronics 170, a sensor may be located on or near the covering drive shaft 130, etc.

The sensor 275 (e.g., Hall effect sensor) monitors rotation of the magnet 238 in the dual mode operation system 200 to track the position of the covering 122. For example, the sensor 275 may track the number of rotations made by the magnet 238 and, thereby, the covering drive shaft 130, from a known reference position (e.g., a fully raised position of the covering 122, a fully lowered position of the covering 122, etc.). Initially, the sensor 275 and electronics 170 may cooperate to determine a known reference position. For example, electronics 170 may operate the drive motor 160 to enable the covering 122 to reach its fully lowered position by operating the drive motor 160 in a lowering direction for a period of time longer than needed to move the covering 122 from a fully raised position to a fully lowered position. The dual mode operation system 200 ensures that the covering 122 reaches a full lowered position. Once the extended lowering has been performed, the electronics 170 can determine a reference position as the fully lowered position of the covering 122 and can track a number of rotations to any point relative to the fully lowered position (e.g., reference position). For example, in one embodiment, when the cord spools 140, 142 are fully unwound, continued operation of the drive motor 160 does not back-wind the cords 141, 143 of the covering 122 on the cord spools 140, 142 (e.g., because the dual mode operation system 200 does not allow the drive motor 160 to apply a rotational force to the covering drive shaft 130 in the unwinding direction and the fully unwound cord spools 140, 142 no longer apply a rotational force to the covering drive shaft 130). Accordingly, once the extended lowering has been performed, the electronics 170 can determine a reference position as the fully lowered position of the covering 122 and can track a number of rotations to any point relative to the fully lowered position (e.g., reference position).

The sensor 275 is mounted in a position that is near an outer edge of the magnet 238. The magnet 238 may be in the form of a continuous cylindrical magnet, although other embodiments are contemplated including, but not limited to, a single pole magnet block, a two-pole magnet, a cylindrical magnet having alternatively poles around its periphery, etc. When rotation tracking is not desired or is provided by another mechanism (e.g., a sensor attached to a drive motor, a sensor attached to covering drive shaft 130, etc.), the intermediate member 234 and the magnet 238 may be omitted.

According to the example embodiment shown in FIG. 2, when the intermediate member 234 and the magnet 238 are included in the dual mode operation system 200, the intermediate member 234 and the magnet 238 may be considered a part of the dual mode operation system 200 as they are at least partially contained therein. As shown, the intermediate member 234 and the magnet 238 are located at an end of the covering drive shaft 130, adjacent the motor mount 202. Accordingly, a distance between the drive motor 160 attached to the motor mount 202 and the magnet 238 may be minimized. Thus, when electronics 170 are coupled with the drive motor 160, the sensor 275 may be mounted on a circuit board of the electronics 170 for tracking the number of rotations made by the magnet 238 and a length of the circuit board (e.g., extending from the drive motor 160 to a position adjacent the magnet 238) may be minimized as compared with mounting the magnet 238 on the covering drive shaft 130 outside of the dual mode operation system 200 and further from the motor mount 202. As shown, the magnet 238 may be mounted between the motor mount 202 and the outer raceway 252 along the covering drive shaft 130. Alternatively, the magnet 238 may be mounted at any location between the motor mount 202 and the slip clutch housing 214 along the covering drive shaft 130.

When detecting rotation of the motor mount 202 relative to the covering drive shaft 130 (e.g., detecting that the drive motor 160 coupled to the motor mount 202 is operating but the magnet 238 is not rotating), it can be determined that rotation of the covering drive shaft 130 is restricted and/or not driven. For example, if the architectural structure covering 100 is coupled to the covering drive shaft 130, fully lowering the covering 122 may eliminate the rotational force that the covering 122 applies to the covering drive shaft 130 (e.g., cord spools 140, 142 attached to the covering drive shaft 130 and wound with the cords 141, 143 attached to the covering 122 may be fully unwound when the covering 122 is fully lowered and, thus, will not translate any rotational force to the covering drive shaft 130), thus, stopping rotation of the covering drive shaft 130 when the attached drive motor 160 is operating in an unwinding direction for the covering 122. When the covering 122 encounters an obstacle during raising (e.g., is fully raised and encounters a stop such as a headrail), continued rotation of the motor mount 202 will overcome the holding force of the spring 230 allowing the slip clutch housing 214 to rotate while the hub 226 and the covering drive shaft 130 are stationary, thus, stopping rotation of the covering drive shaft 130 when the attached drive motor 160 is operating in the winding direction for the covering 122. When such a stoppage of the covering drive shaft 130 is detected, it can be determined that the covering 122 has been fully lowered or raise, respectively, and, for example, operation of the attached drive motor 160 may be terminated.

When detecting rotation of the covering drive shaft 130 relative to the motor mount 202 (e.g., detecting that the drive motor 160 coupled to the motor mount 202 is not operating while the magnet 238 is rotating), it can be determined that an external rotational force is being applied to the covering drive shaft 130. For example, the covering 122 may be pulled downward overcoming the holding force of the spring motor 150, which results in the covering drive shaft 130 rotating while the attached drive motor 160 is not operated (e.g., while the motor mount 202 and the clip clutch housing 214 are stationary). In such a system, when the covering 122 is lifted, the covering drive shaft 130 may rotate in the opposite direction. For example, the spring motor 150 may apply a rotational force to the covering drive shaft 130, a manual controller (e.g., a cord and pulley) may apply a rotational force to the covering drive shaft 130, etc. Such rotation of the covering drive shaft 130 drives rotation of the hub 226, the spring 230, the slip clutch housing 214, and the inner raceway 260. However, the inner raceway 260 decouples this rotation (e.g., because the rotation is in the direction that the outer raceway 252 disengages its inner surface 256 from the outer surface 262 of the inner raceway 260) from the bearing housing 206 and the motor mount 202.

Figure 17:
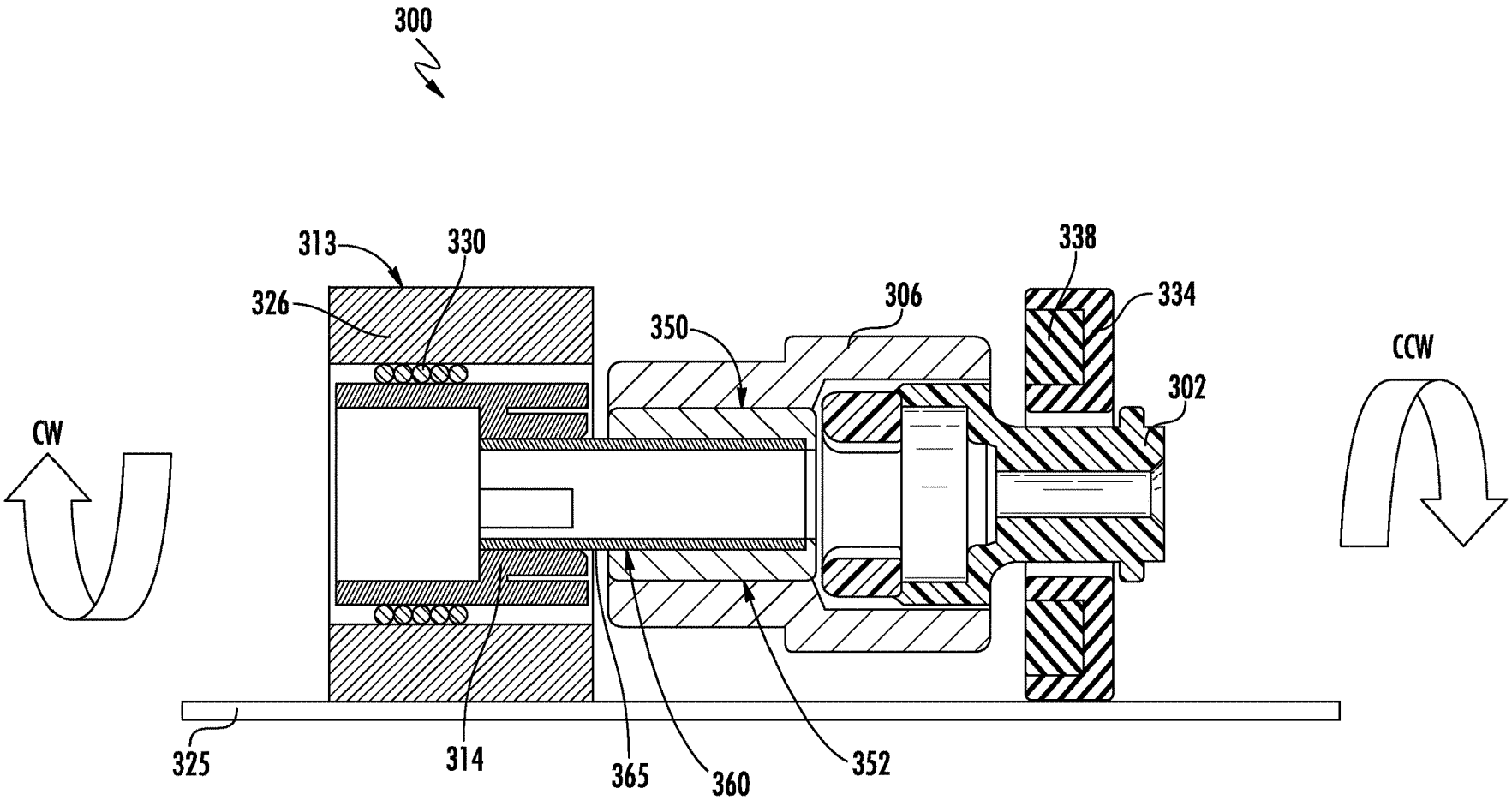
FIG. 17 illustrates a cross-sectional view of an example embodiment of a dual mode operation system which may be used in connection with a roller covering.

Referring to FIG. 17, an alternate exemplary dual mode architecture covering 300 is illustrated. The dual mode architecture covering 300 is substantially similar in elements and operations as the dual mode architecture covering 200 described above except dual mode architecture covering 300 has been specifically designed to work in connection with a roller shade or covering. The dual mode architectural structure covering includes a covering (e.g., a roller shade type covering), a drive shaft (in this embodiment, the roller tube, which transmits a torque to cause the covering to retract or to extend similar to the function of the drive shaft described above in connection with a stacking shade), a drive motor having a motor drive shaft, a dual mode operation system, and, optionally, a sensor system for identifying the location of the covering. In this embodiment, the drive shaft 325 resides on the outside so that the other components reside inside of the drive shaft 325 (as opposed to the drive shaft 130, where the other components sat on or resided on the outside of the shaft 130).

Referring to FIG. 17, an example embodiment of the dual mode operation system 300 is illustrated. As shown, the dual mode operation system 300 includes a motor mount 302, a bearing housing 306, a one-way bearing 350 at least partially disposed within the bearing housing 306, and a slip clutch 313. The motor mount 302 is sized and configured to engage a drive motor or another rotational driver. The motor mount 302 is mechanically-rotatably coupled to the bearing housing 306 so that the motor mount 302 and the bearing housing 306 rotate together (rotation of one results in rotation of the other). Accordingly, rotation of the motor mount 302 (e.g., by the drive motor) drives rotation of the bearing housing 306.

The bearing housing 306 extends from its coupling with the motor mount 302 to at least partially surround and be coupled with the one-way bearing 350. As previously described, the one-way bearing 350 may include an outer raceway, an inner raceway, a separator or cage located between the outer raceway and the inner raceway, and a bearing element so that movement of the outer raceway relative to the inner raceway in one direction allows the outer raceway to freely rotate with respect to the inner raceway. Meanwhile, movement of the outer raceway relative to the inner raceway in the opposite direction causes the outer raceway to lock with respect to the inner raceway.

As previously described, the outer and inner raceways 352, 360 form a one-way bearing that transmits rotation from the outer raceway 352 to the inner raceway 360 (and vice versa) in a first direction of rotation, for example, when the outer raceway 352 rotates in the counter-clockwise direction CCW relative to the inner raceway 360 and the inner raceway 360 rotates in the clockwise direction CW relative to the outer raceway 352. Similarly, rotation is not transmitted between the outer and inner raceways 352, 360 when the outer raceway 352 and the inner raceway 360 rotate in a second relative direction of rotation, for example, when the outer raceway 352 rotates in the clockwise direction CW relative to the inner raceway 360 and the inner raceway 360 rotates in the counter-clockwise direction CCW relative to the outer raceway A transfer shaft 365 may be coupled to the inner raceway 360 so that rotation of the transfer shaft 365 rotates the inner raceway 360. The transfer shaft 365 may extend longitudinally beyond the one-way bearing 350 so that the exposed end of transfer shaft 365 may couple with a slip clutch 313. In use, the transfer shaft 365 transfers rotational forces between the one-way bearing 350 and the slip clutch 313. The slip clutch 313 and the transfer shaft 365 are rotatably coupled to each other.

More specifically, in this embodiment, the slip clutch 313 includes a slip clutch housing 314, a hub 326, and a spring 330. The hub 326 is rotationally coupled to the drive shaft 325. That is, in this embodiment, the outer surface of the hub 330 is coupled to the inner surface of the drive shaft 325. The coupling of the drive shaft 325 to the slip clutch 2313 results in the rotation of the drive shaft 325 to be transmitted through the slip clutch 313 to the inner raceway 360 via the transfer shaft 365, which is rotationally coupled to the inner raceway 360.

In this embodiment, the hub 326 and the spring 330 are located at least partially around the slip clutch housing 314. When a rotational force is applied to the hub 326 by the drive shaft 325 that exceeds the frictional holding force of the spring 330, the hub 326 will rotate even while the slip clutch housing 314 remains stationary, and hence while the inner raceway 360, the outer raceway 352, the bearing housing 306, and the motor mount 302 remain stationary. As such, the one-way bearing 350 causes the inner raceway 360 to be rotationally locked with respect to the outer raceway 352 and hence the drive motor, when the spring 330 applies a holding force a greater than a combined weight of the covering. However, when an additional force is applied, the spring force of the slip clutch 313 can be overcome so that the drive shaft 325 can rotate with respect to the inner raceway 360, the spring 330 allows the hub 326 to rotate with respect to the slip clutch housing 314.

As previously described, in one example embodiment of the dual mode operation system 300, the system 300 may include a rotation tracking or sensing functionality to track the position of the covering. Such functionality can also allow the system to implement upper and lower limits for the covering so that the covering can be moved between fully raised and fully lowered positions. In some embodiments, the electronics may include a sensor used to monitor rotation of the drive shaft 325 to monitor a position of the covering (e.g., by tracking rotation from a known point to determine the position of the covering). The dual mode operation system 300 may include a magnet 338 to interact with the sensor associated with the electronics. In use, the magnet 338 is rotatably coupled with respect to the inner surface of the drive shaft 325. As shown the magnet 338 may be coupled to an intermediate member 334 for mechanically-rotatably coupling the magnet 338 with respect to the inner surface of the drive shaft 325. The magnet 338 is coupled with respect to the intermediate member 334 such that rotation of the drive shaft 325 drives rotation of the intermediate member 334 and, thereby, the magnet 338. Thus, any rotation of the drive shaft 325, whether it be by manual operation or motorized operation, will drive rotation of the magnet 338, which can be tracked by the sensor, as previously described.

Figure 3:
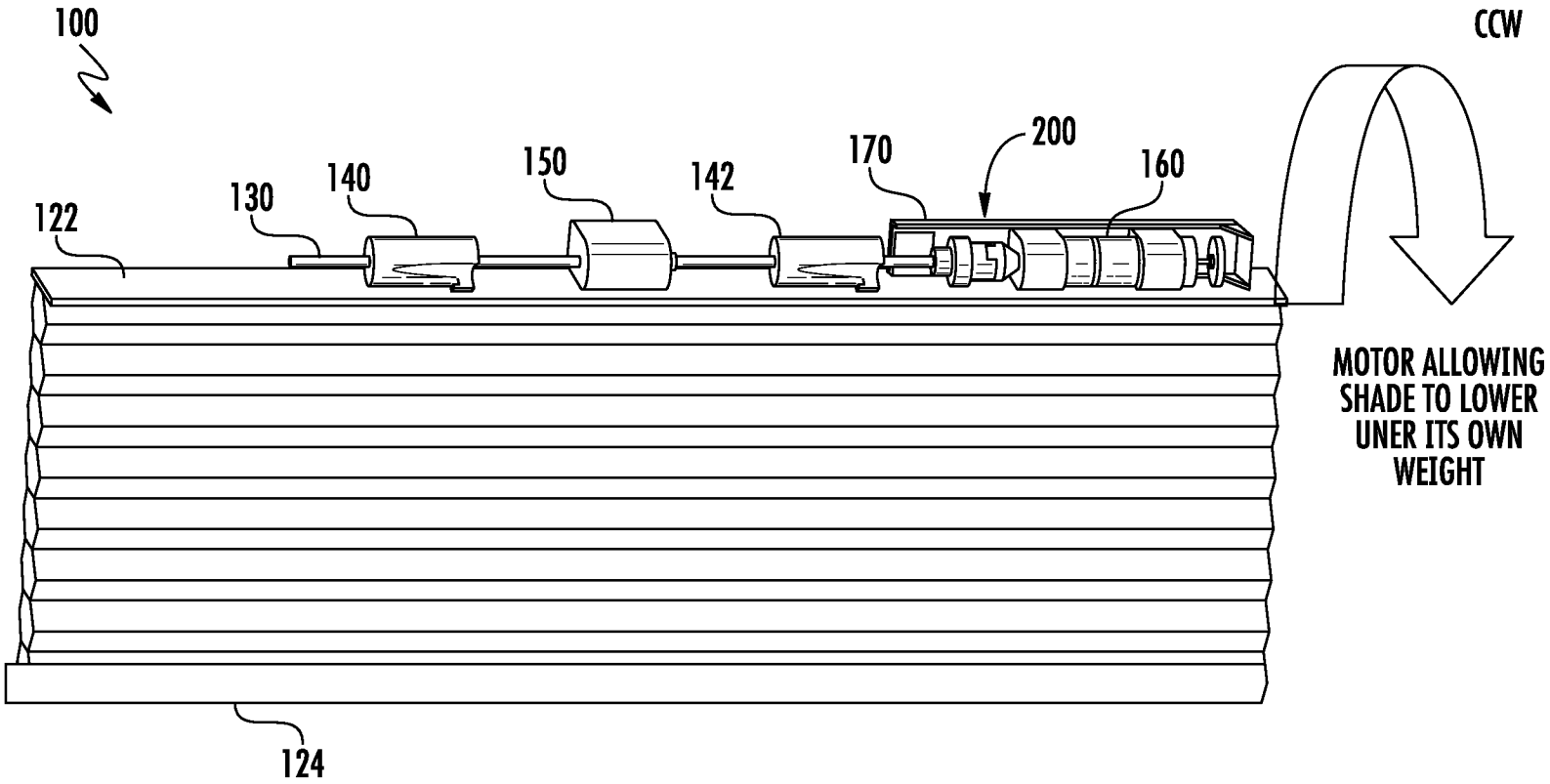
FIG. 3 illustrates a perspective view of the example architectural structure covering of FIG. 1 being lowered by a motorized operation.
Figure 4:
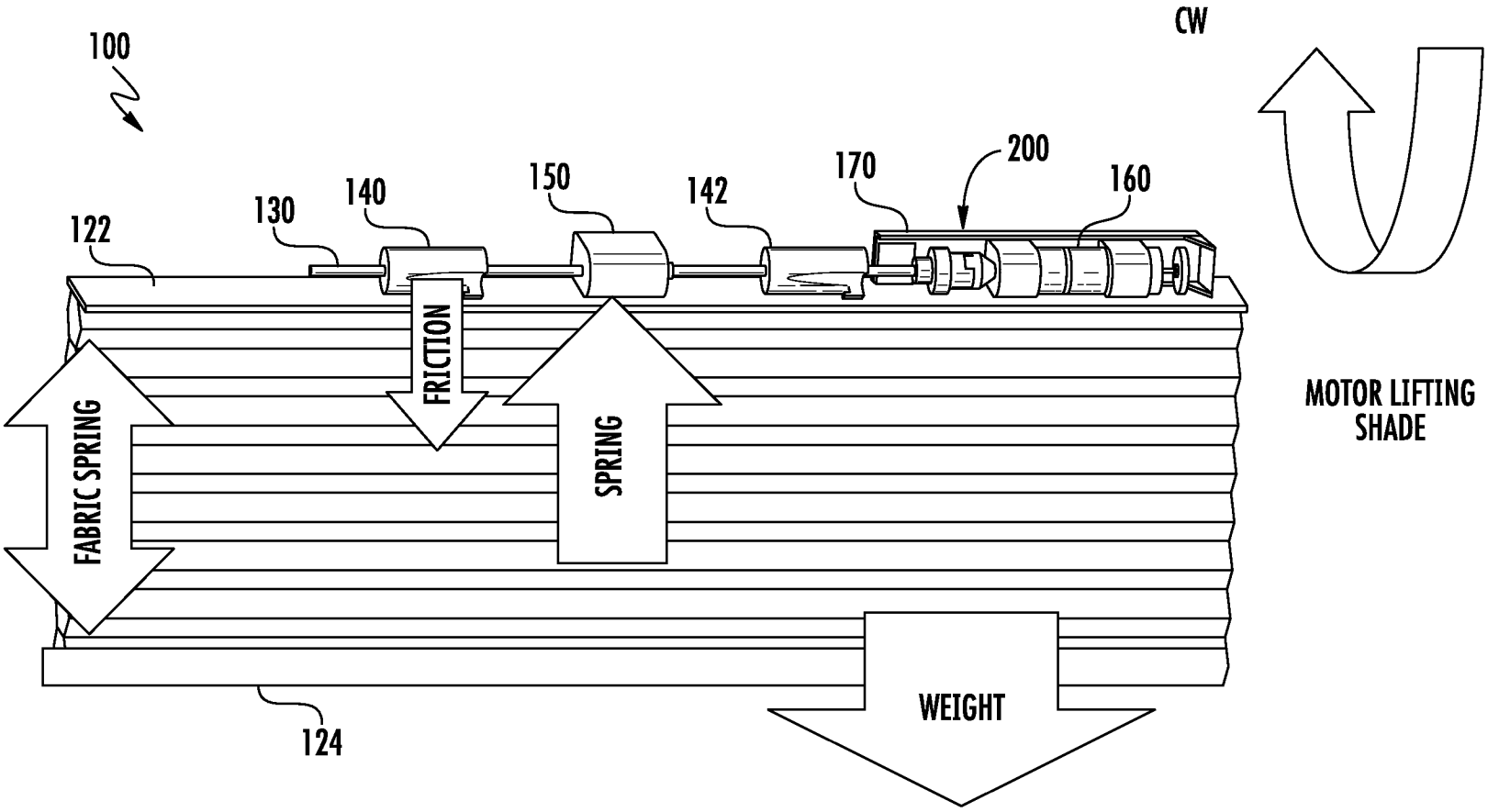
FIG. 4 illustrates a perspective view of the example architectural structure covering of FIG. 1 being raised by a motorized operation.
Figure 5:
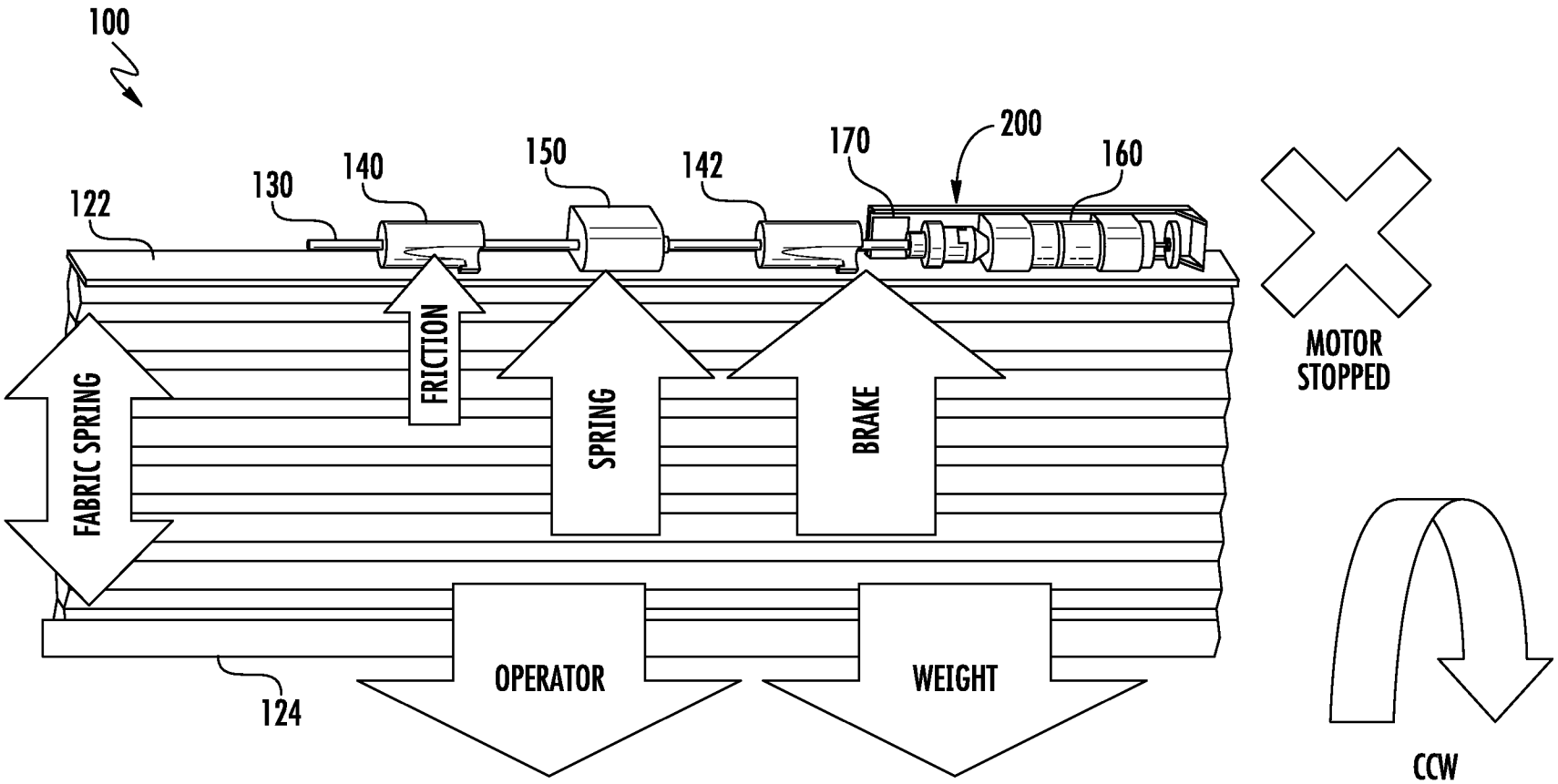
FIG. 5 illustrates a perspective view of the example architectural structure covering of FIG. 1 being lowered by a manual operation.

Referring to FIGS. 3-5, example principles of the multiple modes of operation (e.g., motorized and manual operation) of the example architectural structure covering 100 will now be described. According to the example illustrations, the covering 122 is lowered when the covering drive shaft 130 and the cord spools 140, 142 are rotated in a counter-clockwise CCW (when viewed from the left sides of FIGS. 3-5) and the covering 122 is raised when the covering drive shaft 130 and the cord spools 140, 142 are rotated in a clockwise direction CW. It should be appreciated that although the present system has been described and illustrated as lowering the covering 122 when the covering drive shaft 130 and the cord spools 140, 142 are rotated in a counter-clockwise direction CCW (when viewed from the left sides of FIGS. 3-5) and the covering 122 is raised when the covering drive shaft 130 and the cord spools 140, 142 are rotated in a clockwise direction CW, the direction of rotation is completely arbitrary and the system can easily be manipulated such that the covering 122 can be lowered by rotating in the clockwise direction CW and raised in the counter-clockwise direction CCW (when viewed from the left sides of FIGS. 3-5).

Referring to FIG. 3, a motorized lowering of the architectural structure covering 100 will be described. To lower the architectural structure covering 100, the rotational output of the drive motor 160 rotates counter-clockwise. However, because the dual mode operation system 200 prevents the drive motor 160 from applying torque in the direction of lowering the covering 122, the covering 122 is lowered by various downward forces on the covering 122, such as the combined weight of the covering 122 and the rail 124, that drive the unwinding of the cord spools 140, 142 (e.g., under the gravitational force due to the combined weight of the covering 122 and the rail 124), which overcomes any associated friction and the spring force applied by the spring motor 150. As previously described, the dual mode operation system 200 applies a braking force that prevents the covering 122 from lowering at a rate faster than the rotational output of the drive motor 160. Accordingly, the lowering of the covering 122 can be controlled by controlling a rotation speed of the output of the drive motor 160. If the covering 122 reaches a fully lowered position (e.g., the cord spools 140, 142 are fully unwound) or if the rail 124 reaches an obstruction (e.g., an object blocking the path of the rail 124, a window sill, a floor, etc.), the covering 122 and/or the rail 124 no longer apply an unwinding force on the cord spools 140, 142. If the drive motor 160 continues to operate after the unwinding force ceases, the dual mode operation system 200 does not transmit the unwinding force from the drive motor 160 to the covering drive shaft 130 and, thus, prevents the drive motor 160 from further rotating the covering drive shaft 130. Because the dual mode operation system 200 decouples the motor 160 from the covering drive shaft 130 in the unwinding direction, the dual mode operation system 200 prevents the drive motor 160 from overwinding the cord spools 140, 142 that could start to draw the cords in a reversed direction that is undesirable and may cause damage to the architectural structure covering 100.

Referring to FIG. 4, a motorized raising of the architectural structure covering 100 will be described. To raise the architectural structure covering 100, the rotational output of the drive motor 160 rotates clockwise. The dual mode operation system 200 translates the rotational output of the drive motor 160 to the covering drive shaft 130. Accordingly, the covering drive shaft 130 and, thereby, the cord spools 140, 142 are rotated clockwise to draw up the cords 141, 143 and raise the covering 122 and the rail 124. The force applied by the drive motor 160 overcomes the expanding force of the covering 122 (e.g., the spring force that naturally biases the cells of covering 122 open) and overcomes any frictional forces (e.g., the frictional forces due to rotation of the covering drive shaft 130 in the mounting brackets (not shown) and/or the frictional forces of spring motor 150). If the covering 122 and/or the rail 124 encounter an obstruction (e.g., an object blocking the path of the rail 124, a head rail at a fully raised position of the covering 122, an upper limit, etc.) and the drive motor 160 continues to operate, the dual mode operation system 200 however will slip (e.g., the braking force will be overcome by the drive motor 160) and the covering drive shaft 130 will cease rotating, thereby preventing damage to the covering 122 and/or the rail 124.

Referring to FIG. 5, a manual lowering (e.g., a user applied force while the drive motor 160 is not operated and/or is separate from a force applied by the drive motor 160) of the architectural structure covering 100 will be described. During manual lowering, the drive motor 160 is stationary (e.g., not commanded to operate, not powered, etc.). Alternatively, the drive motor 160 could be operated in parallel with manual operation (e.g., to counter or assist movement of the covering 122). To manually lower the covering 122, a user can, for example, grasp or otherwise engage the covering 122 and/or the rail 124, and pulls the covering 122 and/or the rail 124 away from the cord spools 140, 142 (e.g., pulls downward). As previously described in greater detail, this downward pulling causes the covering drive shaft 130 to rotate in the counter-clockwise direction, which causes the hub 226 and the slip clutch housing 214 (via the spring 230) to rotate in the counter-clockwise direction. In turn, this causes the transfer shaft 265, which is rotationally coupled to the slip clutch housing 214, to rotate and hence the inner raceway 260, which is rotationally coupled to the transfer shaft 265. Rotation of the inner raceway 260 in the counter-clockwise direction relative to the outer raceway 252, causes the outer raceway 252 to lock with respect to the inner raceway 260. As such, counter-clockwise rotation of the inner raceway 260 causes the outer raceway 252, the bearing housing 206, and the motor mount 202 to rotate. However, since the drive motor 160 is not operated, the drive motor 160 applies a resistive holding force to the motor mount 202. The resistive holding force on the motor mount 202 is transmitted via the bearing housing 206, to the outer raceway 252, which is locked to the inner raceway 260, and thus to the slip clutch housing 214 via the transfer shaft 265. When the force applied by the user (e.g., combined with the gravitational force due to the weight of the covering 122 and the rail 124), exceeds the frictional forces, the lifting force of the spring motor 150, and the braking force of the slip clutch 213, the covering drive shaft 130 and the hub 226 will rotate with respect to the spring 230 and the slip clutch housing 214, thereby decoupling the rotation of the covering drive shaft 130 from the drive motor 160. Accordingly, the covering drive shaft 130 rotates to lower the covering 122 and the rail 124 (or otherwise moved away from the cord spools 140, 142) and, thus, unwind the cords 141, 143 from the cord spools 140, 142, while the drive motor 160 is not operated and/or is stationary. Thus, the user-applied force overcomes the braking force of the slip clutch 213 and the cord spools 140, 142 are able to rotate relative to the drive motor 160, allowing the architectural structure covering 100 to be lowered undamaged. The braking force of the slip clutch 213 is overcome at a force that is less than a holding force of the drive motor 160 (e.g., the drive motor 160 has a holding force of approximately 5 pounds and the slip clutch 213 has a braking force of approximately 4 pounds).

Figure 6:
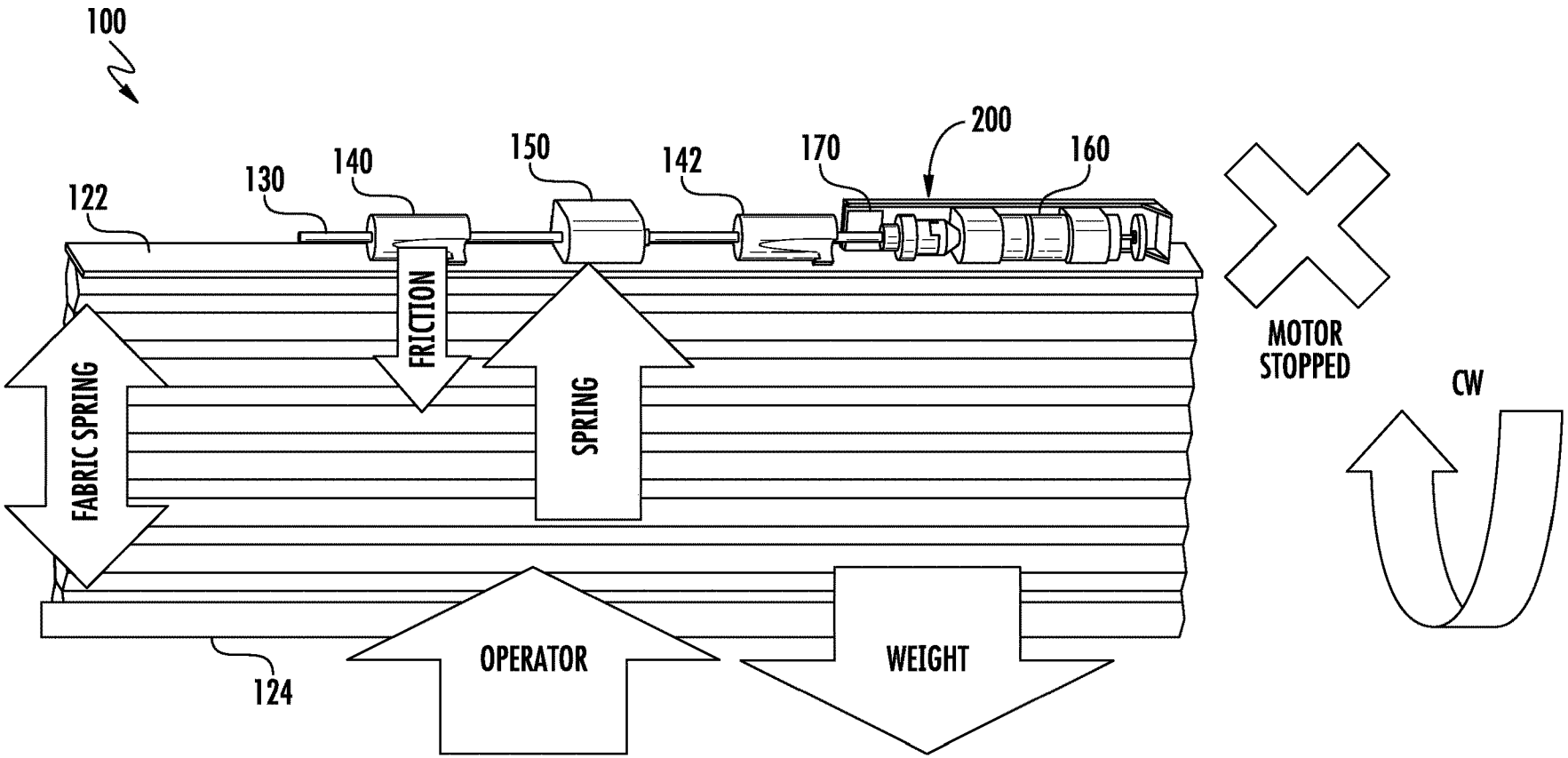
FIG. 6 illustrates a perspective view of the example architectural structure covering of FIG. 1 being raised by a manual operation.
Figure 7A:
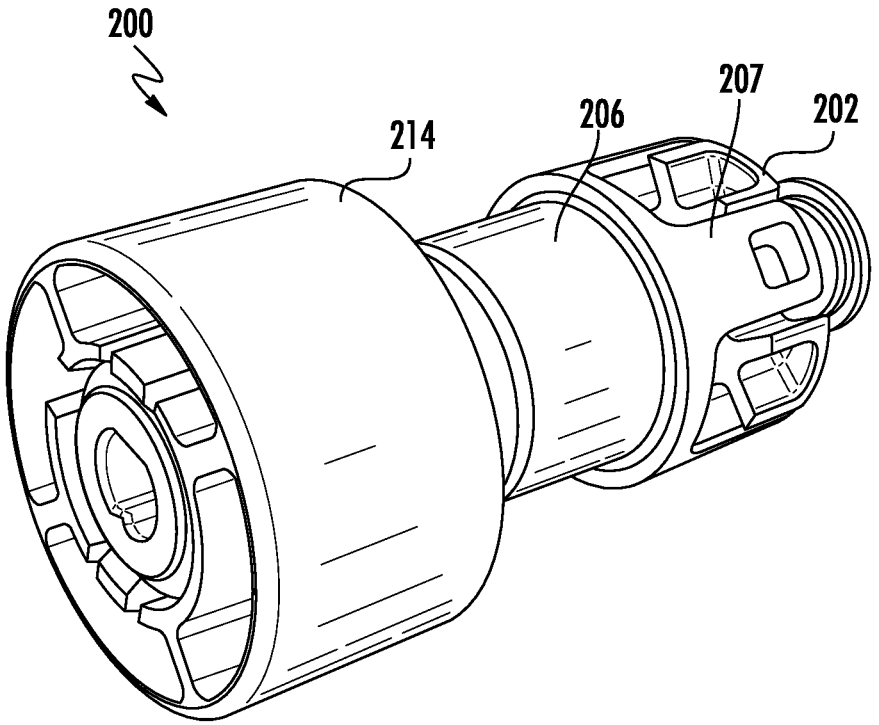
FIG. 7A illustrates a front perspective view of the example embodiment of the dual mode operation system of FIG. 2.
Figure 7B:
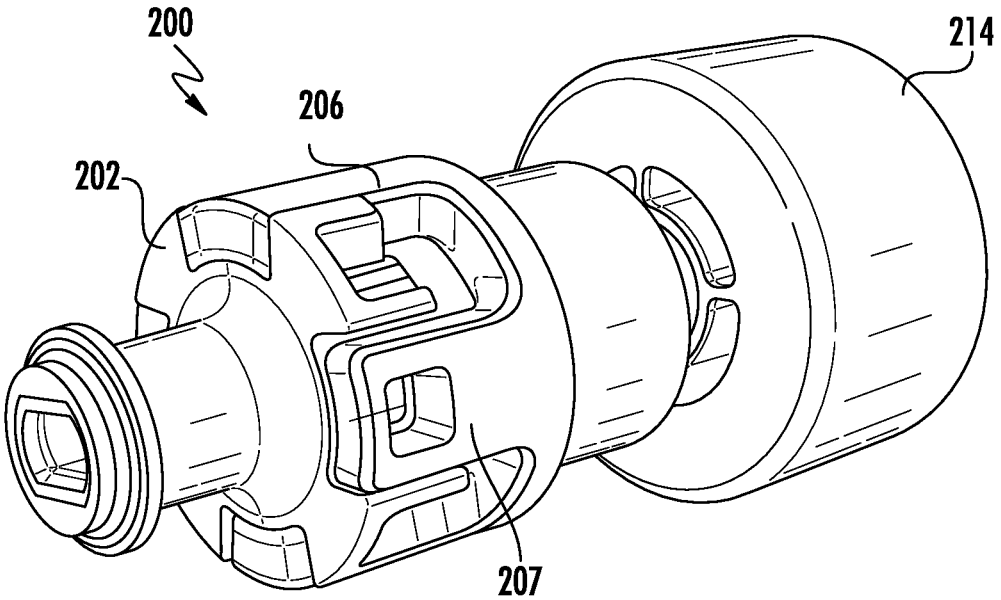
FIG. 7B illustrates a rear perspective view of the example embodiment of the dual mode operation system of FIG. 2.
Figure 8A:
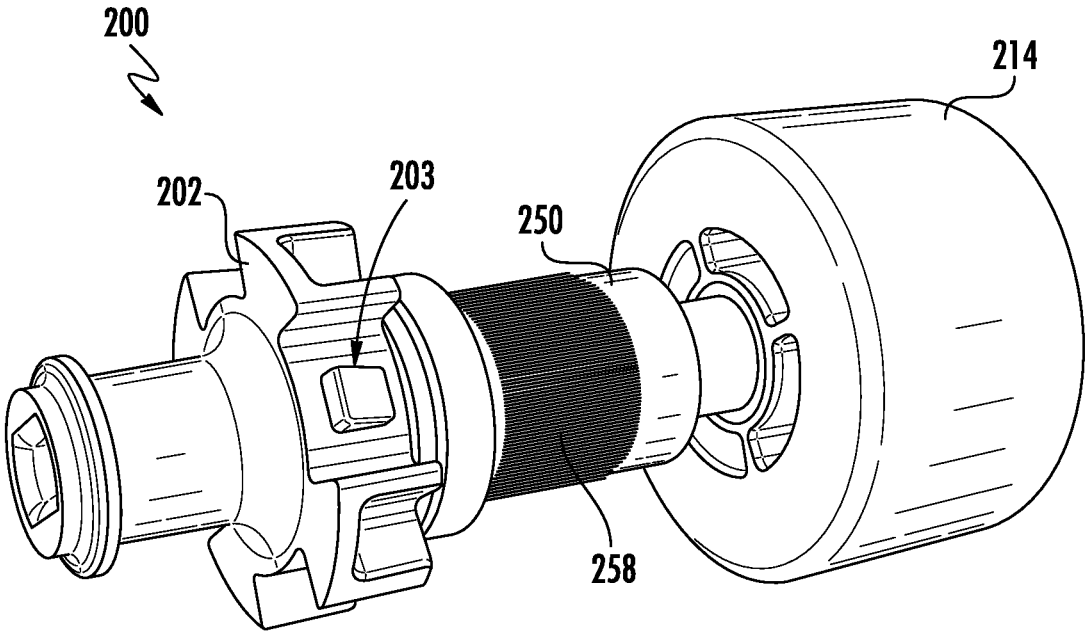
FIG. 8A illustrates a rear perspective view of the example embodiment of the dual mode operation system of FIG. 2 with the bearing housing removed.
Figure 8B:
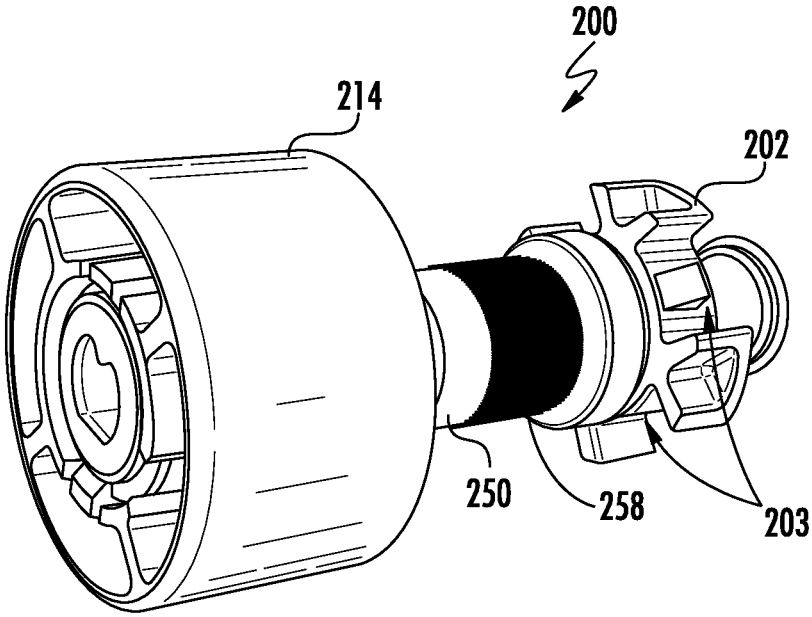
FIG. 8B illustrates a front perspective view of the example embodiment of the dual mode operation system of FIG. 2 with the bearing housing removed.
Figure 9:
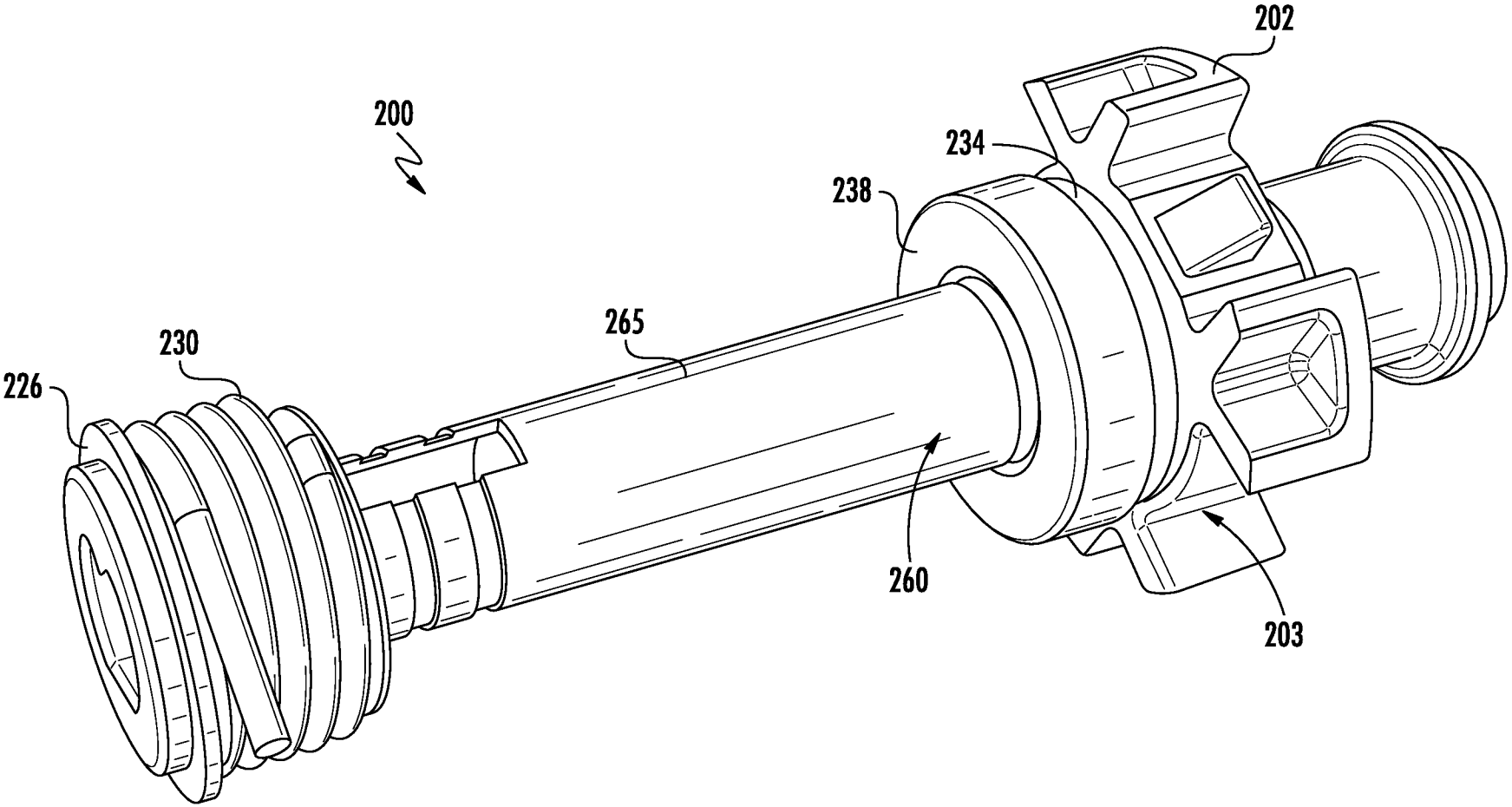
FIG. 9 illustrates a front perspective view of the example embodiment of the dual mode operation system of FIG. 2 with the bearing housing, the outer raceway, and the slip clutch housing removed.

Referring to FIG. 6, a manual raising (e.g., a user applied force while the drive motor 160 is not operated and/or is separate from a force applied by the drive motor 160) of the architectural structure covering 100 will be described. Alternatively, the drive motor 160 could be operated in parallel with the manual operation (e.g., to counter or assist movement of the covering 122). To manually raise the covering 122, a user, for example, grasps or otherwise engages the covering 122 and/or the rail 124 and lifts/pushes the covering 122 and/or the rail 124 towards the cord spools 140, 142 (e.g., lifts upward). Thus, the force due to the weight of the covering 122 and the rail 124 is reduced or eliminated with respect to the lifting force of the spring motor 150 with the cord spools 140, 142. Accordingly, the lifting force of the spring motor 150 with spools 140, 142 causes the cords 141, 143 attached to the covering 122 and the rail 124 to be taken up on the spools 140, 142 overcoming the spring force of the cellular fabric of the covering 122 and present frictional forces. During a manual raising of the covering, the covering drive shaft 130 rotates in the clockwise direction causing the slip clutch housing 214 to rotate in the clockwise direction via the hub 226 and the spring 230. As a result, the slip clutch housing 214 rotates the transfer shaft 265 and the inner raceway 260 in the clockwise direction. Rotation of the inner raceway 260 in the clockwise direction, is the equivalent of rotating the outer raceway 252 rotating in the counter-clockwise direction CCW. Rotation of the outer raceway 252 in the counter-clockwise direction CCW causes the outer and inner raceways 252, 260 to rotate freely with respect to each other. Thus, rotation of the covering drive shaft 130 is not transmitted to the drive motor 160. Accordingly, the holding force of the drive motor 160 does not restrict the rotation of the covering drive shaft 130 during manual raising of the covering 122.

In one example embodiment, the dual mode architectural structure covering comprises a drive shaft, a covering coupled to rotate with rotation of the drive shaft, a drive motor having a motor drive shaft, and a dual mode operation system. The dual mode operation system including a bearing housing, a slip clutch, and a one-way bearing. The bearing housing is coupled to rotate with the motor drive shaft, the slip clutch is coupled to rotate with and selectively to slip with respect to the drive shaft, and the one-way bearing is selectively, rotatably coupled to the bearing housing and the slip clutch such that in a first direction, the slip clutch and the bearing housing are rotatably coupled with each other so the slip clutch, and the housing rotate together, and in a second direction, the slip clutch and the bearing housing are freely rotatable with respect to each other so the slip clutch and the housing are rotatable with respect to each other.

In the first direction, rotation of the drive motor causes the motor drive shaft to rotate the bearing housing, the one-way bearing, the slip clutch, and the drive shaft to wind the covering into a retracted configuration. In the second direction, a weight of the covering provides a downward gravitational force and the drive motor acts as a speed governor enabling the downward gravitational force to lower the covering. The one-way bearing and the motor drive shaft rotate freely with respect to each other so long as the motor drive shaft rotates at the same speed or faster than the one-way bearing.

The one-way bearing includes an outer raceway and an inner raceway, the outer raceway being coupled to rotate with rotation of the bearing housing, the inner raceway being coupled to rotate with rotation of the slip clutch. The inner raceway is associated with a transfer shaft for coupling the one-way bearing to a housing of the slip clutch. The transfer shaft is hollow for receiving a portion of the drive shaft therein.

The slip clutch comprises a slip clutch housing, a hub coupled to rotate with the drive shaft, and a spring interconnecting the slip clutch housing and the hub, the slip clutch housing is coupled to the one-way bearing via a transfer shaft. The one-way bearing locks relative movement between the motor drive shaft and the slip clutch, and the drive shaft that is rotatable coupled to the slip clutch, the slip clutch selectively releases to allow slippage between the motor drive shaft and the drive shaft despite the one-way bearing being locked. An upward force applied to the covering without operating the drive motor causes the drive shaft to rotate in the second direction, causing the slip clutch to rotate with respect to the bearing housing so that rotation from the slip clutch is not transferred to the bearing housing.

A rotational axis of the motor drive shaft is parallel to a rotation axis of the drive shaft.

The dual mode architectural structure further comprising a spring motor for applying a force to the drive shaft for biasing the covering in a retracted position.

The dual mode architectural structure further comprising a motor mount for coupling the bearing housing to the motor drive shaft, the motor mount being coupled to the bearing housing so that rotation of the output shaft by the drive motor rotates the motor mount and the bearing housing.

The dual mode architectural structure covering further comprising a sensor system for identifying a position of the covering, the sensor system including a magnet coupled to rotate with the shaft and a Hall effect sensor mounted adjacent to the magnet to monitor rotation of the magnet, and hence the position of the covering. The one-way bearing including a position sensor coupled to the shaft, the dual mode architectural structure covering further including a sensor to monitor rotation of the position sensor to track a position of the covering. The sensor is mounted to a circuit board attached to the drive motor.

In one example method for operating an architecture structure covering having a drive shaft operatively coupled to the covering to cause the covering to retract or to extend upon rotation of the drive shaft, and a motor with a motor drive shaft coupled to the drive shaft to selectively rotate the drive shaft, the method comprising: coupling a drive shaft to a motor drive shaft via a slip clutch and a one-way bearing; rotating the drive shaft in a first direction in which the one-way bearing locks the drive shaft and the motor drive shaft from rotating with respect to each other; and applying an additional rotational force to the drive shaft to rotate the drive shaft in the first direction, the additional rotational force causing the slip clutch to slip to allow the drive shaft to rotate with respect to the motor drive shaft.

The method further comprising applying a user-applied force to rotate the drive shaft in the first direction. The method further comprising rotating the drive shaft in a second direction opposite the first direction, wherein when the drive shaft rotates in the second direction relative to the motor drive shaft, the drive shaft and the motor drive shaft rotate freely with respect to each other. The method further comprising rotating a drive motor coupled with the motor drive shaft to rotate the one-way bearing, the slip clutch, and the drive shaft to wind the covering into a retracted configuration. Rotating a drive motor to rotate the one-way bearing, the slip clutch, and the drive shaft comprises rotating the motor drive shaft in a second direction opposite the first direction to cause the one-way bearing to lock the drive shaft and the motor drive shaft from rotating with respect to each other. The method, further comprising rotating a drive motor connected to the motor drive shaft in a second direction, opposite the first direction, so that the motor drive shaft and the one-way bearing rotate freely with respect to each other so long as the drive motor rotates at the same speed or faster than the one-way bearing.

It should be appreciated that although elements have been described as being rotationally coupled with respect to one or more other elements, it is contemplated that the elements may be directly coupled or indirectly coupled via one or more intermediate elements.

From the foregoing, it will be appreciated that the above disclosed dual mode operation system selectively-rotatably couples a drive motor to a drive shaft (e.g., a drive shaft of an architectural structure covering 100). Some disclosed examples include a position sensing system within the dual mode operation system. When such a dual mode operation system is attached to a drive shaft of the architectural structure covering, the position sensing system rotates during manual and motorized operation to ensure that a sensor can track a position of a covering of the architectural structure covering during.

Although certain methods, apparatus, and articles of manufacture have been disclosed herein, the scope of coverage of this patent is not limited thereto. On the contrary, this patent covers all methods, apparatus, and articles of manufacture fairly falling within the scope of the claims of this patent.

What is claimed is:

1. A dual mode architectural structure covering comprising:

a drive shaft;

a covering coupled to rotate with rotation of the drive shaft;

a drive motor having a motor drive shaft; and a dual mode operation system, the dual mode operation system arranged and configured to operate in a first mode to enable motorized extension and retraction of the covering and in a second mode to enable manual extension and retraction of the covering, the dual mode operation system including a bearing housing, a slip clutch, and a one-way bearing;

wherein:

the bearing housing is coupled to rotate with the motor drive shaft;

the slip clutch is coupled to rotate with and selectively to slip with respect to the drive shaft; and the one-way bearing is selectively, rotatably coupled to the bearing housing and the slip clutch;

in the first mode, when the drive motor is rotated in a first direction to retract the covering, the bearing housing, the one-way bearing, and the slip clutch rotate in the first direction;

in the first mode, when the drive motor is rotated in a second direction to extend the covering, the bearing housing, the one-way bearing, and the slip clutch rotate in the second direction;

in the second mode, when the covering is manually moved in a first direction to retract the covering, the drive shaft and the slip clutch rotate in the first direction and rotate relative to the one-way bearing and the bearing housing, which remain stationary; and in the second mode, when the covering is manually moved in a second direction to extend the covering, the drive shaft rotates in the second direction relative to the one-way bearing and the bearing housing, which remain stationary.

2. The dual mode architectural structure covering of claim 1, wherein a rotational axis of the motor drive shaft is parallel to a rotation axis of the drive shaft.

3. The dual mode architectural structure covering of claim 1, further comprising a spring motor for applying a force to the drive shaft for biasing the covering in a retracted position.

4. The dual mode architectural structure covering of claim 1, further comprising a motor mount for coupling the bearing housing to the motor drive shaft, the motor mount being coupled to the bearing housing so that rotation of the motor drive shaft by the drive motor rotates the motor mount and the bearing housing.

5. The dual mode architectural structure covering of claim 1, further comprising a sensor system for identifying a position of the covering, the sensor system including a magnet coupled to rotate with the drive shaft and a Hall effect sensor mounted adjacent to the magnet to monitor rotation of the magnet, and hence the position of the covering.

6. The dual mode architectural structure covering of claim 1, wherein in the second mode, when the covering is manually moved in a second direction to extend the covering, the drive shaft rotates in the second direction relative to the one-way bearing and the bearing housing, which remain stationary due to slippage of the slip-clutch.

7. The dual mode architectural structure covering of claim 1, wherein, in the first mode, when the drive motor is rotated in the first direction, rotation of the drive motor causes the motor drive shaft to rotate the bearing housing, the one-way bearing, the slip clutch, and the drive shaft to wind the covering into a retracted configuration.

8. The dual mode architectural structure covering of claim 7, wherein, in the first mode, when the drive motor is rotated in the second direction, a weight of the covering provides a downward gravitational force and the drive motor acts as a speed governor enabling the downward gravitational force to lower the covering.

9. The dual mode architectural structure covering of claim 8, wherein, in the first mode, when the drive motor is rotated in the second direction, the one-way bearing and the motor drive shaft rotate freely with respect to each other so long as the motor drive shaft rotates at the same speed or faster than the one-way bearing.

10. The dual mode architectural structure covering of claim 1, wherein the one-way bearing includes an outer raceway and an inner raceway, the outer raceway being coupled to rotate with rotation of the bearing housing, the inner raceway being coupled to rotate with rotation of the slip clutch.

11. The dual mode architectural structure covering of claim 10, wherein the inner raceway is associated with a transfer shaft for coupling the one-way bearing to a housing of the slip clutch.

12. The dual mode architectural structure covering of claim 11, wherein the transfer shaft is hollow for receiving a portion of the drive shaft therein.

13. The dual mode architectural structure covering of claim 1, wherein the slip clutch comprises a slip clutch housing, a hub coupled to rotate with the drive shaft, and a spring interconnecting the slip clutch housing and the hub, the slip clutch housing is coupled to the one-way bearing via a transfer shaft.

14. The dual mode architectural structure covering of claim 13, wherein the one-way bearing locks relative movement between the motor drive shaft and the slip clutch, and the drive shaft that is arranged and configured to rotate relative to the slip clutch, the slip clutch selectively releases to allow slippage between the motor drive shaft and the drive shaft despite the one-way bearing being locked.

15. The dual mode architectural structure covering of claim 14, wherein, in the second mode, when the covering is manually moved in the first direction to retract the covering, the slip clutch rotates with respect to the bearing housing so that rotation from the slip clutch is not transferred to the bearing housing.

16. The dual mode architectural structure covering of claim 1, wherein the one-way bearing includes a position sensor coupled to the drive shaft, the dual mode architectural structure covering further including a sensor to monitor rotation of the position sensor to track a position of the covering.

17. The dual mode architectural structure covering of claim 16, wherein the sensor is mounted to a circuit board attached to the drive motor.

18. The dual mode architectural structure covering of claim 1, wherein the one-way bearing includes an outer raceway and a transfer shaft for coupling the outer raceway to a housing of the slip clutch, the outer raceway being coupled to rotate with rotation of the bearing housing, the transfer shaft being coupled to rotate with rotation of the slip clutch.

19. The dual mode architectural structure covering of claim 18, wherein the transfer shaft is hollow for receiving a portion of the drive shaft therein.

* * * * *